United States Patent [19]

Ganz

[11] Patent Number: 5,059,311

[45] Date of Patent: Oct. 22, 1991

[54] METHOD AND APPARATUS FOR SEPARATING PARTICULATE SOLIDS

[76] Inventor: John M. Ganz, 346 S. Pennsylvania Ave., Wellston, Ohio 45692

[21] Appl. No.: 224,447

[22] Filed: Jul. 26, 1988

[51] Int. Cl.[5] ..... B03B 5/22; B03B 5/24

[52] U.S. Cl. ..... 209/455; 29/500; 29/503

[58] Field of Search ..... 209/455–457, 209/490, 496, 500, 501, 503

[56] References Cited

U.S. PATENT DOCUMENTS

| | | | |
|---|---|---|---|
| 372,741 | 11/1887 | Card | 209/455 |
| 901,474 | 10/1908 | Richards | 209/455 |
| 1,146,682 | 7/1915 | Amis | 209/457 |
| 1,926,408 | 9/1933 | Sayers | 209/500 |
| 2,027,597 | 1/1936 | Lide | 209/455 |
| 2,132,750 | 10/1938 | Muller | 209/500 X |
| 2,314,428 | 3/1943 | Schouten | 209/500 X |
| 3,703,237 | 11/1972 | Cohen-Alloro et al. | 209/500 X |
| 4,176,749 | 12/1979 | Wallace et al. | 209/500 X |

FOREIGN PATENT DOCUMENTS

| | | | |
|---|---|---|---|
| 0017863 | of 1930 | Australia | 209/455 |
| 46-41206 | 12/1971 | Japan | 209/455 |
| 0426702 | 11/1974 | U.S.S.R. | 209/500 |
| 0005975 | of 1912 | United Kingdom | 209/456 |
| 1584016 | 2/1981 | United Kingdom | 209/500 |

*Primary Examiner*—Margaret A. Focarino
*Assistant Examiner*—Edward M. Wacyra
*Attorney, Agent, or Firm*—Richard M. Klein; Paula E. Ganz

[57] ABSTRACT

An improved process and apparatus for separating particulate solids based on differences in their specific gravities through agitation in alternating upward and downward water/liquid currents generated by discharges from a water/liquid column of fluctuating height, stored in a water/liquid holding tank connected laterally to and/or above the pulse chamber of a separation jig, wherein the intensity of the discharges and the upward and downward currents thus created are a function of the height of the water/liquid column, which is in turn responsive to the condition and composition of the body of particulate solids undergoing separation.

35 Claims, 9 Drawing Sheets

METHOD AND APPARATUS FOR SEPARATING PARTICULATE SOLIDS

The present invention is directed to an improved process and apparatus for separating particulate solids based on differences in their specific gravities through agitation in alternating upward and downward water/-liquid currents generated by discharges from a water/-liquid column of fluctuating height, stored in a water/-liquid holding means connected laterally to and/or above the pulse chamber of a separation jig, wherein the intensity of said discharges and the upward and downward currents thus created are a function of the height of the water/liquid column, which is in turn responsive to the condition and composition of the body of particulate solids undergoing separation.

DESCRIPTION OF THE PRIOR ART

Jigging is a well known process for concentrating ore particles such as iron ore, lead-zinc ore, tin barite, etc. and/or for cleaning crushed coal particles in various fluid media depending upon differences in the specific gravities of the granular particles to be concentrated and/or separated. Although somewhat different terms of art are used to describe the jigging process as applied to ore "concentration" rather than to coal "cleaning", the process and principles of the jigging process are the same regardless of application. The jigging process causes the stratification of a feed or granular particles of mixed composition into layers of different specific gravities (and hence, different composition), allowing for the easy separation and removal of the stratified granular particles.

When jigging is utilized to concentrate ore particles, a mixture of ore particles, supported on a perforated plate or screen in a body or "bed" with a depth many times the thickness of the largest particle, is subjected to alternating rising (i.e. "pulsion") and falling (i.e. "suction") flow of fluid or currents with the objective of causing all of the particles of higher specific gravity to travel to the bottom of the bed while the particles of lower specific gravity collect at the top of the bed. During the rising (i.e. "pulsion") flow of fluid, the particulate bed is lifted and "opened" so that the particles move upward and apart from each other in the fluid. During the falling (i.e. "suction") flow of fluid, the particles fall downward in the fluid current toward the perforated plate or screen support, and the bed becomes more compact as the interstitial space between the particles decreases. Also, during the falling (i.e. "suction") flow of fluid, the higher specific gravity particles move downward more quickly than those of lower specific gravity, thus forming stratified layers with the higher specific gravity particles tending to collect in the lower strata. Although the effect of the falling flow of fluid is commonly referred to as a "suction", the term is something of a misnomer since no true suction (or negative pressure) is applied to the fluid or the particles. In fact, in the prior art true suction (or negative pressure) has been applied but the results proved to be unsatisfactory in that true suction (or negative pressure) hampered, rather than assisted, proper separation of the solids particles. The better explanation is that the upward pulsion current ceases, and the fluid and the particles suspended in the fluid are simply permitted to fall downward under the influence of gravity.

The fluid in which the particles are suspended and undergo separation is typically water, but additives may be injected into the water or some other fluid, whether liquid or gas, may be utilized. Those skilled in the art will recognize that, although the particulate solids are most commonly suspended and agitated in water, water additives may be present, or other liquids or gases may be utilized. For convenience and in keeping with the normal usage of the literature, in this writing the fluid of suspension and agitation is frequently identified as water; however it is in no way intended to restrict the invention to the utilization of pure water as the fluid of suspension and agitation. The invention may be utilized with water additives and liquids and gases other than water.

The process of stratifying particles according to their specific gravity may be further complicated by the wide size distribution of some feeds (particularly coal feeds). Very small particles are often present in the feed, along with much larger particles. The size of the particles is generally unrelated to their specific gravity, so that there is a wide size distribution of particles of both light and heavy specific gravity. As the body of solids becomes more compact during the falling flow of fluid, and the interstitial space between particles contracts, the very small particles may be able to move downward through the contracting interstices between the larger particles, while the fall of larger particles may be blocked. This size effect counteracts to some extent the principle of separation according to specific gravity, and longer jigging time or further processing may be necessary to obtain a well-defined specific gravity separation.

In addition to the upward a-d downward currents, in continuous jigs, there is also generally a surface-carrying current, which serves to transport the lighter particles forward over the heavier particles for discharge from the jigging apparatus.

The alternating rising and falling currents of the jigging process produce a stratification of the ore particles in the bed as the ore particles pass from the feed end to the discharge end in a continuous jigging process. In ore concentration, the desired ore product is usually contained in the higher density strata. The separated products produced in the jigging process are designated as follows: (1) the "floats", which form the top layer which is carried over the heavier particles continuously by the carrying current; (2) the "coarse concentrate", also called the "sinks", which forms the heavy or lower layer upon the screen, and is composed of particles too coarse to fall through the screen; and, (3) the "hutch product" or "fine concentrate", which consists of particles which fall through the screen into the "hutch" portion of the jig, which are subsequently removed from the hutch by a running spigot or by an elevator. In addition, the "coarse concentrate" layer may also be further divided into different sub-layers, such as top and bottom layers, depending upon differences in specific gravities of the particles. Hence, the jigging process produces a clear separation and/or concentration of different granular products depending upon differences in specific gravities.

Furthermore, after an allowance of a sufficient period of time to produce the desired stratification, the jigging products, i.e. the floats and the coarse concentrate, are normally removed and separated from the jig. Removal of the floats is generally obtained by the carrying current, while removal of the top layer of the coarse concentrate may be obtained through crowding by new feed. The bottom layer may be removed by drawing it through a gate or well or by causing it to travel on the screen to a discharge end.

Jigging may also be utilized for cleaning or upgrading crushed coal. However, coal jigging differs from ore concentration jigging in the following aspects:

1. The coal is the light or low specific gravity part of the feed and is generally the greater part by volume; and,
2. The feed size tends to be large, a 6 in. $\times$0 mesh distribution is not unusual.

Although the basic principles of coal jigging do not differ substantially from that of ore concentration jigging, as a result of the above differences and the reversal of the specific gravities of the desired product (i.e. coal) and the waste product (i.e. embanking rock, etc.), a different stratum (i.e. the floats) contains the final product (coal particles). The heavier layer of particles which remains on the screen is "refuse". In a jig with a number of cells, the heavy layer of particles removed from the screen supports of the first few cells contains so much unwanted material that it may be treated as "refuse", removed through a "refuse" elevator, and usually not subjected to further processing. The heavier material removed from the remaining cells may contain more coal, and is referred to as "middlings". The "middlings" may be retained for further processing to recover more of the coal product. Of course, the same principles may apply to imperfectly separated strata in ore concentration.

During the coal cleaning or upgrading operation, the specifically heavier refuse or waste material accumulates in the lower layer and the specifically lighter coal in the upper layer. The light coal actually follows the upwardly directed water pulses faster than the heavy waste. Consequently, the coal is driven farther upwardly. During the downward movement of the water, the coal and waste exhibit unequal dropping velocities. The heavier waste particles generally drop faster than the coal and, consequently, accumulates at lower levels. Therefore, in coal jigging processes, the upper lighter layer, as opposed to the lower heavier layer, contains the desired product.

In regard to the different types of apparatuses utilized in the art for sustaining jigging processes, there are principally two types of jigs: jigs with movable sieves or screens, which generate or create the currents by moving the screen up and down in the water, either manually or by power; and, jigs with fixed sieves or screens, in which the currents are produced by some type of mechanical means such as by a plunger, piston, or diaphragm or by a stream of hydraulic fluid, brought forth through either air or fluid pulsion, into the hutch (that is, the space beneath the screen), or by both.

A fixed sieve or screen jig, which will be referred to as a fixed screen jig throughout this writing, consists basically of a fixed sieve or screen which supports a bed of ore or coal particles submerged in water in a tank which is provided with means for bringing the particle bed into partial suspension at regularly recurrent intervals. Water is fed through the screen in a pulsating fashion so that during the downward current, the particles are allowed to settle back onto the screen and after some repetitions of the pulsion-suction cycle, the particles in the bed stratify with the light minerals or particles (i.e. the floats) on top and the heavy minerals or particles (i.e. the sinks) at the bottom. Water pulsations are commonly provided by having a pulsion means such as a diaphragm at the bottom of the tank below the screen (i.e. the hutch) which is periodically flexed or a burst of pressure is applied to an air or water chamber which is in communication with the perforated screen. The water pulsations produced provide both a suspending upward-pulse of water and a settling suction action with each cycle of operation. Continuous operation is achieved by removing the floats off the top and collecting the concentrate from the screen and/or by allowing the concentrate to pass through the screen into the hutch as hutch product. Some finer solids, however, do not form a proper bed on the screen, and an artificial bed composed of larger particles such as feldspar or the like (called "ragging") can also be used to enhance separation.

The fundamental principles of all modern fixed bed type jigs are essentially the same. The basic design features are:

1. a horizontal screen to support the mineral bed;
2. a hutch or tank containing liquid beneath the screen;
3. a means of creating a jig stroke or relative motion between the liquid and the bed;
4. a method of modulating the jig-stroke wave form;
5. a method of regulating water up-flow;
6. a method of supplying feed to the bed; and,
7. a method of removing products from above the screen and from the hutch.

The basic differences between the various types of fixed screen jigs are a matter of engineering of one or more of the above basic design features to optimize the operating performance, material handling, maintenance and control of the jigs and the products produced thereby.

The type of fixed-screen jig most commonly used today is an air-generated pulsation jig, often called a Baum jig after the inventor of one of the earliest embodiments of the air-pulsation concept. Several varieties of the air-generated pulsation Baum jig are in use with various means for producing and/or modulating the pulsion-suction currents. In addition, Baum jigs used in the industry today also differ from one another in regard to the methods utilized for i) coal feeding, ii) air pulse formation, and iii) product removal.

One widely utilized modification of the Baum jig is designed to counteract the difficulty of uneven distribution of the pulsion current across the perforated plate or screen in larger jigs. In such jigs, multiple air inlets are positioned under the screen to more evenly distribute the pulsion current across the screen. In addition, in such jigs the multiple air inlets are typically associated with some sort of dispersion arrangement under the screen which acts to further distribute the pulsion across the screen. These jigs are particularly effective for the separation of feed streams containing fine coal particles.

A typical air-generated pulsation jig will be described for purposes of generally describing the prior art with references to FIGS. 1 and 2. FIG. 1 is a front elevational view in section of a standard Baum jig. FIG. 2 is a side elevational view taken from line 1—1 of FIG. 1. As indicated in FIGS. 1 and 2, a typical air-generated pulsation jig consists of one or more individual cells 12 having a "U-tube" shaped construction separated from one another by partitions 14 in a casing 10. Each cell is comprised of an air chamber 18, a water chamber 16 and a separation chamber 17. Partition 15 separates the air chamber 18 and the air expansion chamber 19 from the separation chamber 17 in each U-shaped cell. A screen support 20, which separates the water chamber 16 from separation chamber 17, is mounted across the upper portions of water chambers 16. A feed port 22, for a particulate body 34 of granular solids to be separated, is connected to screen support 20 at an upper portion of one end of the casing 10. Discharge port 24, and discharge gate 26 for lighter and heavier density particles, respectively, are connected to screen support 20 at the other end (i.e. the downstream end) of casing 10. The particulate body 34 of granular solids to be separated rests on the screen support 20 which has a meshed or sieved surface, or suitable ragging in case of hutch separations, in such a manner that it will allow water to flow freely through it.

Each of the air chambers 18 is provided therein with an air pipe 28 extended therethrough from the outside of the casing 10. Air pipe 28 is connected to air blower 48 which maintains a constant air pressure inside the air chamber 18. In addition, each of the air chambers 18 is connected to an air impulse valve 50 by air intake pipe 52 and air exhaust pipe 54. The air impulse valve 50 allows air to be cyclically pulsed into the air expansion chamber 19 and then exhausted to create the water pulsations which act to separate the particles.

In addition, each of the water chambers 16 is provided at a lower portion thereof with a make-up water pipe 30 and valve 32 extended therethrough from the outside of the casing 10. Water is stored in the hutch compartment 40 of each of the water chambers 16.

In the normal operation of a Baum jig, a conveyor means 23 delivers the particulate body 34 consisting of the materials to be separated such as crushed coal or mineral ores, and other heterogeneous materials such as embanking rocks, etc. to feed port 22. The particulate body 34 is fed from the feed port 22 onto the screen support 20. Push water 41 is added to the particulate body 34 of granular solids as it passes through the feed port 22 to better distribute the solids across the width of the screen support 20. The pulverulent body 34 of granular solids are propelled through the jig by the crowding from the continuous flow of additional feed and by the push water 41 and the make-up water 30.

As the particulate body 34 of the granular solids travels down the screen support 20, pressurized air is fed and discharged periodically through valve 50 to and from the air expansion chambers 19. Owing to the periodical feeding and discharge of the pressurized air, the water-levels in the water chambers 16 and separating chambers 17 are displaced up and down repeatedly. Such vertical displacement of the water level causes the particulate body 34, which has been fed from the feed port 22 onto the screen support 20, to be moved vertically in the separation chamber 17 as it is agitated. The particulate body 34 of granular solids is first lifted and "opened" by an upward movement of water through the particulate bed during the pulsion phase of the cycle, as a burst of compressed air forces water up through the particulate body 34 of granular solids. Then, when the air is exhausted, the water retreats back through the particulate bed and the screen support 20. During the second phase of the cycle (i.e. the suction phase), the solid particles are subject to a drag from the downward movement of the water which, along with the gravitational force, tends to cause the granular solids to settle back onto the screen support 20. Thus, the cycling of upward and downward forces, causes separation and stratification of the lower density solids from the higher density solids.

As the particulate body is moved from feed port 22 toward a downstream end of the casing 10 the particulate body becomes better stratified with the heavier density particles falling more quickly during the downward (or suction) phase of the cycle and thus stratifying on the bottom of the bed of the particulate body 34 to form lower layer 38, and the lower density particles fall more slowly and thus stratify towards the top of the bed of the particulate body 34 to form upper layer 36. The particles of the particulate body 34 that have a lower specific gravity are recovered from the upper discharge port 24 with the overflowing water, while the particles thereof that have a higher specific gravity are moved on the screen support 20 to be removed from the jig by discharge gate 26. Screen support 20 may be sloped slightly to guide the higher specific gravity material toward the discharge gate 26.

The discharge of the higher density particles from the jig may be automated with a float 42 at the discharge gate 26 sensing and monitoring the thickness of the particle bed. Float 42 causes the discharge gate 26 to open when the particle bed reaches a preset thickness and then closes after evacuation.

In addition, fine, heavy particles may fall through the openings in the screen support 20 and settle at the bottom of the water chamber 16 in the hutch compartment 44. These particles are carried out of the hutch compartment 44 by a running spigot (not pictured), or by a rotating hutch screw 46 for removal by an elevator (not pictured).

As the above described operation is repeated continuously, the particulate body 34 is separated into particles having a lower specific gravity 36 and particles having a higher specific gravity 38.

The end product retained for further processing depends upon the type of particles desired to be retrieved after separation. In some mineral separation processes, the desired product is the high density solids such as gold, iron ore, etc. In other mineral separation processes, the desired product is the lower density solids, such as coal. Hence, the jigs may be individually adapted to separate and/or concentrate the desired end products.

However, notwithstanding the separation advantages produced by known fixed-bed jigs such as that of the Baum jig described above, great difficulties have been experienced in the art as a result of the unavoidable variability in the composition of the particulate body of granular solids. There are several factors which contribute to this difficulty. First, the composition, and therefore the specific gravity, of the granular particles in the feed stream is not constant. Additionally, the size distribution of the granular particles in the feed stream varies considerably. In analyses of a jig operation, it is often implicitly assumed that size distribution and specific gravity of the feed is essentially constant. However, this is not the case. Although the overall weight or volume of feed transferred to the conveyor may be regulated, it is not possible to maintain a constant size distribution or material make-up in the feed. Over a period of time, the predominant composition of the feed stream might shift from smaller, heavier particles to larger, lighter particles to larger, heavier particles, and so forth. The effect of this variability on jig operation is common knowledge in the trade. Extra upward thrust is often useful to force large heavy particles out of the solids bed, yet enhanced downward suction may be needed to pull small heavy particles down into the bed.

Hence, it is very difficult to adjust the variables in the pulsation cycle to produce an optimum result, particularly when the composition of the raw feed stream is changing.

Another cause of variability in the composition of the granular particulate body is simply inherent to the intermittent manner in which the higher density solids ("sinks" or "rejects" in coal washing terminology) are accumulated and then removed from the granular bed. The intermittent discharge of the higher density solids causes the overall specific gravity of the granular bed to change abruptly near the discharge gate. Between discharges, heavy impurities accumulate on the screen support, particularly adjacent to the discharge gate and under the float.

In addition, the prior art methods of generating water pulsations fail to properly compensate for changes in the composition of the granular solids bed. The unavoidable variability in the composition of the granular solids bed affects the resistance which the bed offers to the cyclical water pulsations. When the granular solids bed becomes heavier, it offers more resistance to the upward pulsations, in effect acting to dampen the effectiveness of the upward pulsion. The result is that less water penetrates the solids bed, and more of the low density material remains trapped within the solids bed.

Alternatively, when the solids bed becomes less heavy, it offers less resistance to the upward pulsions. The water then lifts more material from the solids bed, disturbing the solids bed stratification to an excessive degree. The result is that small particles of the high density material fail to stratify as they should. Instead, these particles are carried out of the solids bed by the water and misplaced in the low density stream (the "floats"). In either case, the efficiency of the separation process is reduced.

Furthermore, there is a feedback effect which exacerbates the shortcomings of the prior art. When the solids bed becomes heavier, it dampens the force of the water pulsations and more of the heavier material accumulates on the screen. Consequently, the solids bed grows progressively heavier and subsequent water pulsations are not always forceful enough to break the trend. Alternatively, when the solids bed becomes lighter, the water pulsations create progressively greater disruptions. The solids bed then continues to grow lighter as the high density materials fail to settle and stratify. In either case, subsequent water pulsations exaggerate, rather than correct, the problem of a changed granular bed composition. This feedback effect is always opposite to the response that would best compensate for the variations in the characteristics and composition of the granular bed. Various pneumatic, electronic, and radioisotope sensing and control devices intended to improve performance are currently available, but are of limited utility. Recent innovations attempt to correct this difficulty, but not in the manner that the present invention proposes.

An additional difficulty with the prior art practice of mineral separation is that the make-up water flow to the jig is normally supplied by a continuously open inlet valve. The open inlet valve allows water to flow into the cell during the exhaust phase of the pulsation cycle, hindering settling of the granular bed. In addition, air generating pulsation jigs require air blowers and air valves which are very noisy, contributing substantially to environmental discomfort in the work place.

Moreover, the prior art methods and jigs for separating particles produce a number of difficulties in the separation of extremely high density solids, i.e. solids with a specific gravity greater than 1.9. First, during the suction phase of the cycle, the heavier particles fall down onto the screen support more rapidly, quickly forming a more compact granular bed with less interstitial space. This hinders the return of water through the granular bed so that more water tends to become trapped above the bed, and less water is available for the next pulsation. Secondly, any changes in the generally heavier bed are particularly disruptive. For example, the heavier bed is more difficult to lift and, in order to be adequate, the air-generated pulsations used in the prior art must be more powerful. If the particulate bed becomes lighter for any reason, the more powerful (and generally invariable) air generated pulsations are overly powerful, and disrupt the particulate solids bed excessively, interfering with efficient stratification.

An additional difficulty that has been experienced in the prior art occurs in the washing of particularly fine particles, such as coal particles less than ⅜". Such fine particles tend to form a more compact bed with less interstitial space to accommodate the downward return of water during the suction phase of the cycle. More water is trapped above the solids bed, and the suction phase of the cycle is less effective because the downward water current and the overall drag on the particles is reduced. Moreover, the effectiveness of the next water pulsation is reduced, because the water trapped above the solids bed leaves less water available under the screen support to surge upward through the granular bed at the next pulsation cycle (only a very limited amount of additional water, i.e. make-up water, is supplied under the current methods).

It has now been found that the limitations of the above described conventional methods and apparatuses for concentrating ore particles and/or cleaning coal particles can be overcome by the present invention.

SUMMARY OF THE INVENTION

It is therefore the object of the present invention to provide a method and apparatus for producing water/-liquid pulsations in a solids separation jig through the use of gravitational pressure produced by a fluctuating water and/or liquid column stored in a water/liquid holding means located laterally to, and/or above, the pulse chamber of a separation jig, wherein the water and/or liquid pulsations produced thereby are responsive to, and compensate for, normal variations in the composition of the bed of granular particles to be separated.

More particularly, the present invention relates to an apparatus for separating particulate solids comprising at least one separation cell having a pulse chamber for generating water and/or liquid pulsations, a water/liquid chamber for transferring the generated water/liquid pulsations, a perforated screen support for supporting particulate solids, and a separation chamber for separating the particulate solids. The pulse chamber, the water/liquid chamber, and the separation chamber are in fluid communication with one another through the openings in the screen support. In addition, the apparatus contains a means for feeding the particulate solids to be separated onto the perforated screen support, and at least one water/liquid holding means extending laterally to or above the pulse chamber. The water/liquid holding means stores unused water and/or liquid accumulated from previous pulsation cycles, and water and/or liquid supplied at a preset rate from a water/liquid supply means to produce a water and/or liquid column possessing a gravitational pressure head. Furthermore, the apparatus contains an inflow means connected between the water/liquid holding means and the pulse chamber for regulating the inflow of stored water and/or liquid from the water/liquid holding means into the pulse chamber of the separation cell. When the inflow means is in an open position, the water/liquid holding means is in fluid communication with the pulse chamber, thereby allowing for the stored water and/or liquid from the water/liquid holding means to enter into the pulse chamber to produce a water and/or liquid pulsion in the separation cell whenever the gravitational pressure head of the stored water and/or liquid from the water/liquid holding means is sufficient to overcome the resistance of the particulate solids supported on the screen support. Moreover, the apparatus has an outflow means connected laterally to or below the pulse chamber of the separation cell for regulating the outflow of water and/or liquid from the separation cell. The outflow means is regulated alternatively to the inflow means to produce the suction phase of the water and/or liquid pulsations. Lastly, a means for removing the separated solids produced by the water and/or liquid pulsations from the separation cell is also provided in the apparatus.

The present invention is also directed to an apparatus for separating particulate solids according to differences in their specific gravities through the use of water and/or liquid generated pulsations, comprising at least one separation cell having a pulse chamber with a means for receiving water and/or liquid and generating a water and/or liquid pulsation, a water/liquid chamber for transferring the generated water and/or liquid pulsations, a perforated screen support for supporting the particulate solids, and a separation chamber for separating the particulate solids according to differences in their specific gravities The pulse chamber, the water/liquid chamber, and the separation chamber are in fluid communication with one another through openings found in a perforated screen support. A dispersion arrangement may be mounted beneath the perforated screen support to more evenly distribute the force of the pulsion across the screen support and the bed of particulate solids. In addition, the apparatus contains a means for feeding the particulate solids to be separated onto the perforated screen support, and at least one water/liquid holding means connected laterally to and/or above the pulse chamber. The water/liquid holding means stores unused water and/or liquid accumulated from previous pulsation cycles and water and/or liquid supplied at a preset rate from a water and/or liquid supply means to produce a water and/or liquid column possessing a gravitational pressure head. Furthermore, the apparatus has at least one used water/liquid holding means extending laterally to and/or below the pulse chamber, wherein the used water/liquid holding means channels used water and/or liquid from the pulse chamber. Adjustable baffle plates located within the used water/liquid holding means may be utilized to regulate the rate and amount of outflow from the separation cell. Moreover, an inflow/outflow means is connected between the water/liquid holding means and the pulse chamber. An inflow/outflow means is connected between the water/liquid holding means, the pulse chamber, and the used water/liquid holding means for regulating the inflow and outflow of water and/or liquid from the pulse chamber of the separation cell. Specifically, the inflow/outflow means permits the inflow of stored water and/or liquid from the water/liquid holding means into the pulse chamber of the separation cell to produce a water and/or liquid pulse in the separation cell whenever the gravitational pressure head of the stored water and/or liquid from the water/liquid holding means is sufficient to overcome the resistance of the particulate solids supported on the screen support. In addition, the inflow/outflow means also permits the outflow of water and/or liquid from the pulse chamber of the separation cell into the used water/liquid holding means to complete the water and/or liquid pulsation cycle in the separation cell. Lastly, a means for removing separated particles produced by the water and/or liquid pulsations from the separation cell is also provided in the apparatus.

In addition, the present invention also relates to a rotary valve which can be utilized as the inflow/outflow means in the present invention. The rotary valve has a housing, and an internal chamber in which a rotor is mounted for rotation on a drive shaft. The housing is provided with an inlet port which is in fluid communication with the water/liquid holding means, an inflow/outflow port which is in fluid communication with the pulse chamber, and an outlet port which is in fluid communication with the used water/liquid holding means. The rotor itself comprises four wall means which are mounted at equal 90° intervals on a drive shaft to form four separate sectors. An arc-shaped cover is connected between the first and the second wall means and between the third and fourth wall means to form alternative blind sectors which prevent fluid flow. The remaining sectors formed by the second and third wall means and the fourth and first wall means are open for fluid communication. The various ports of the rotary valve may be partially covered by an adjustable cover to diminish the effective 90° arc of the rotary valve if this is beneficial to enhance separation by altering certain characteristics of the pulsion-suction cycle, such as creating shorter pulsion time relative to the suction time, or causing an interval of time to elapse between the end of the pulsion phase and the beginning of the suction phase in the pulsion-suction cycle.

Another aspect of the present invention is directed to a process for separating particulate solids according to their differences in specific gravities through the use of water and/or liquid generated pulsation cycles. The process comprises feeding the particulate solids to be separated into an apparatus containing at least one separation cell having a pulse chamber with a means for receiving water and/or liquid and generating a water and/or liquid pulsation, a water/liquid chamber for transferring the generated water and/or liquid pulsation, a perforated screen support for supporting the particulate solids, and a separation chamber for separating the particulate solids according to their differences in specific gravities. The pulse chamber, the water/liquid chamber, and the separation chamber of the apparatus are in fluid communication with one another through the openings found on the screen support. Moreover, the apparatus contains a means for feeding the particulate solids to be separated onto the perforated screen support, and at least one water/liquid holding means extending laterally to and/or above the pulse chamber, wherein the water/liquid holding means stores unused water and/or liquid accumulated from previous pulsation cycles and water and/or liquid supplied at a preset rate from a water/liquid supply means to produce a water and/or liquid column possessing a gravitational pressure head. The apparatus also contains an inflow means connected between the water/liquid holding means and the pulse chamber for regulating the inflow of stored water/liquid from the water/liquid holding means into the pulse chamber of the separation cell. When the inflow means is in an opened position, the water/liquid holding means is then in fluid communication with the pulse chamber, thereby allowing for the stored water and/or liquid from the water/liquid holding means to enter into the pulse chamber to produce a water and/or liquid pulsation in the separation cell whenever the gravitational pressure head of the stored water and/or liquid from the water/liquid holding means is sufficient to overcome the resistance of the particulate solids supported on the screen support. Furthermore, the apparatus is provided with an outflow means which is connected laterally to or below the pulse chamber of the separation cell for permitting the outflow of water and/or liquid from the separation cell. The outflow means is regulated alternatively to the inflow means to thereby produce the water and/or liquid pulsations in the separation cell. In addition, the apparatus also contains a means for removing the separated solids produced by the water and/or liquid pulsations from the separation cell. Upon separation of the particulate solids originally fed into the apparatus, the separated end products are then removed from the apparatus in separate streams.

A further aspect of the present invention is directed to a method of separating particulate solids according to their differences in specific gravities through the use of an apparatus containing a single inflow/outflow regulating means. The process comprises feeding the particulate solids to be separated into an apparatus containing at least one separation cell having a pulse chamber for generating a water and/or liquid pulsation, a water/liquid chamber for transferring the generated water and/or liquid pulsation, a perforated screen support for supporting particulate solids, and a separation chamber for separating the particulate solids according to their differences in specific gravities. The pulse chamber, the water/liquid chamber, and the separation chamber are in fluid communication with one another through openings found on the perforated screen support. Adjustable baffle plates located within the used water/liquid holding means may be utilized to regulate the rate and amount of outflow from the separation cell. The apparatus also contains a means for feeding the particulate solids to be separated onto the perforated screen support, and at least one water/liquid holding means extending laterally to and/or above said pulse chamber, wherein the water/liquid holding means stores unused water and/or liquid accumulated from previous pulsation cycles and water and/or liquid supplied at a preset rate from a water/liquid supply means to produce a water and/or liquid column possessing a gravitational pressure head. Furthermore, the apparatus contains at least one used water/liquid holding means extending laterally to and/or below said pulse chamber, wherein the used water/liquid holding means channels used water and/or liquid from the pulse chamber. A dispersion arrangement may be mounted beneath the perforated screen support to more evenly distribute the force of the pulsion across the screen support and the bed of particulate solids. An inflow/outflow means connected between the water/liquid holding means, the pulse chamber, and the used water/liquid holding means, is also provided in the apparatus. The inflow/outflow means permits the inflow of stored water and/or liquid from the water/liquid holding means into the pulse chamber of the separation cells to produce a water and/or liquid pulse in the separation cell whenever the gravitational pressure head of the stored water and/or liquid from the water/liquid holding means is sufficient to overcome the resistance of the particulate solids supported on the screen support. In addition, the inflow/outflow means permits the outflow of water and/or liquid from the pulse chamber of the separation cell into the used water/liquid holding means to complete the water and/or liquid pulsation cycle in the separation cell. A means for removing the separated particles produced by the water and/or liquid pulsations from the separation cell is also provided in the apparatus. The final step in the separation process concerns removing the separated end products produced by the apparatus as a final product, or for further processing.

Lastly, the present invention is directed to a process for separating particulate solids according to their differences in specific gravities using an apparatus having a single inflow/outflow means comprising a rotary valve having a housing, and an internal chamber in which a rotor is mounted for rotation on a drive shaft. The housing of the rotary valve is provided with an inlet port, which is in fluid communication with the water/liquid holding means, an inflow/outflow port which is in fluid communication with the pulse chamber, and an outlet port which is in fluid communication with the used water/liquid holding means. In addition, the rotor comprises a first wall means, a second wall means, a third wall means, and a fourth wall means mounted at equal 90° intervals on a drive shaft to form four separate sectors. An arc shaped cover is connected between the first and second wall means and between the third and the fourth wall means to form alternative blind sectors which prevent fluid flow. The remaining sectors formed by the second and the third wall means and the fourth and first wall means are open for fluid communication. The various ports of the rotary valve may be partially covered by adjustable covers attached to the inner housing of the ports to diminish the effective 90° arc of the rotary valve if this is beneficial to enhance separation by altering certain characteristics of the pulsion-suction cycle, such as creating a shorter pulsion time relative to the suction time, or causing an interval of time to elapse between the end of the pulsion phase and the beginning of the suction phase in the pulsion-suction cycle.

BRIEF DESCRIPTION OF THE INVENTION

The invention may take physical form in certain parts and arrangements of parts, a preferred embodiment of which will be described in detail in the specification and illustrated in the accompanying drawings which form a part hereof and wherein.

DETAILED DESCRIPTION OF THE INVENTION

Figure 2:
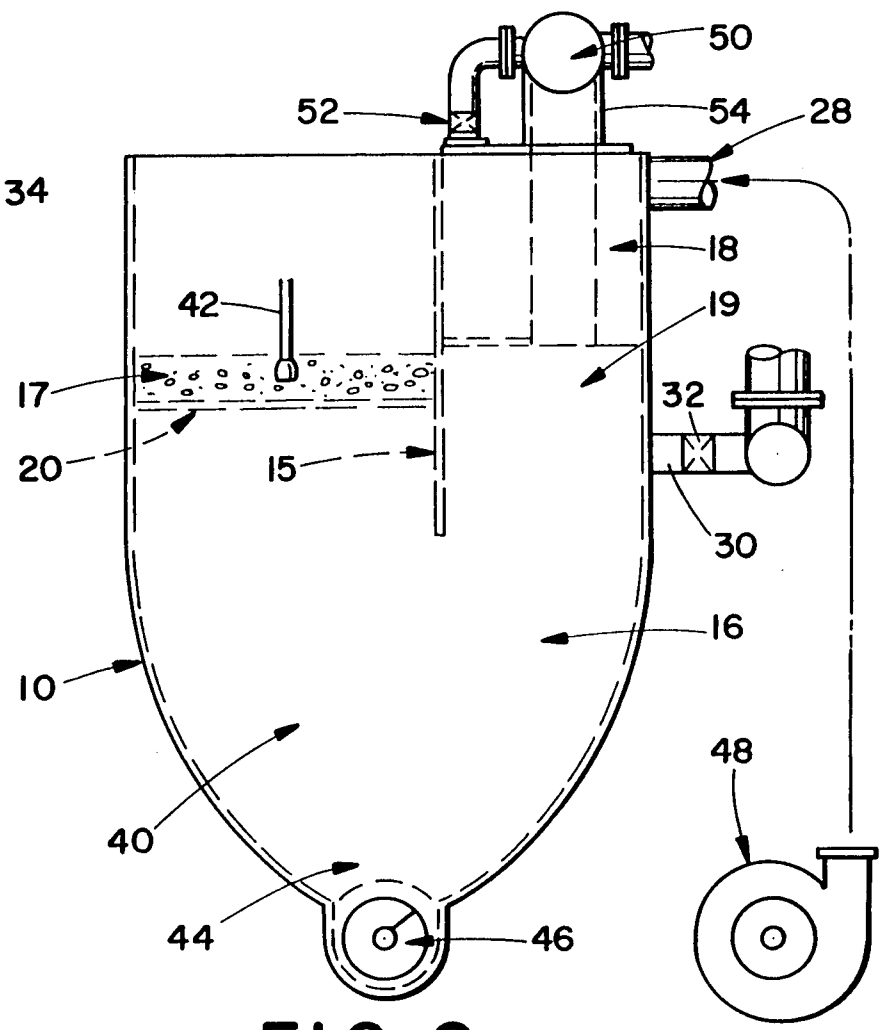
FIG. 2 (PRIOR ART)
FIG. 2 is a side elevational view of a conventional air generated Baum jig as viewed from line 1—1 of FIG. 1.
Figure 1:
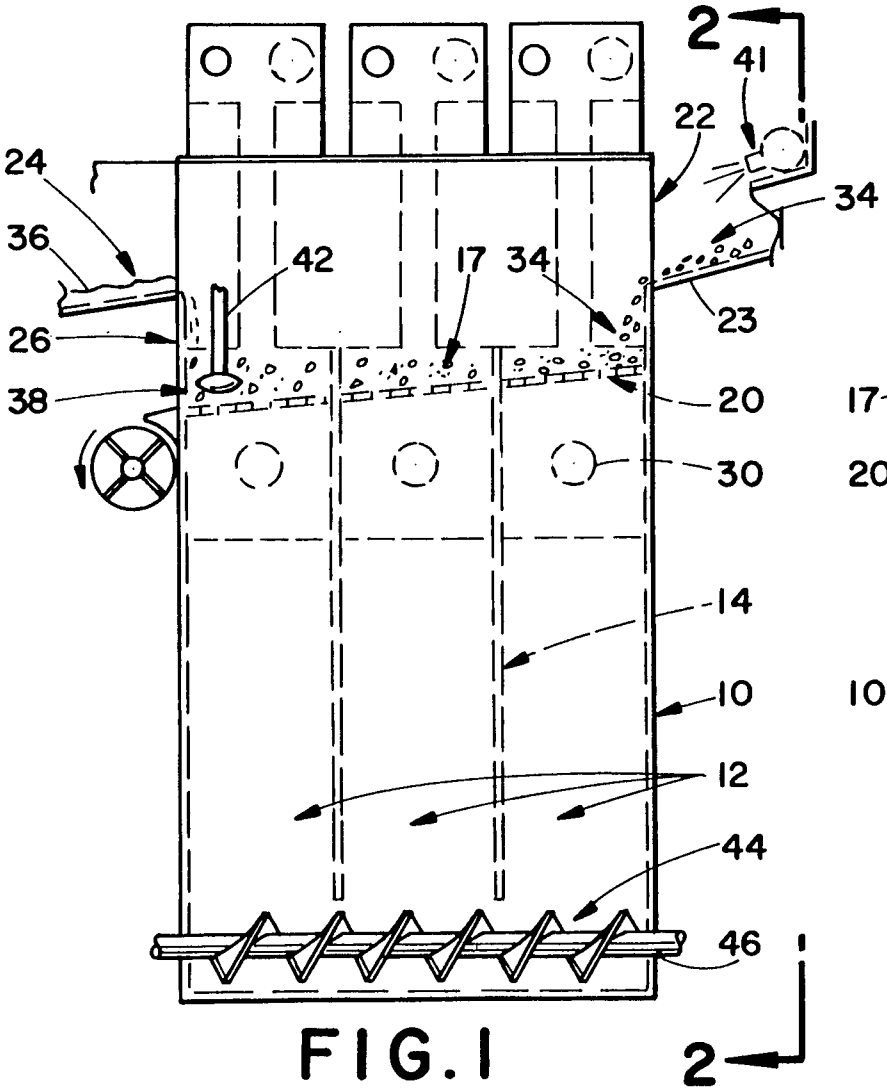
FIG. 1 (PRIOR ART)
FIG. 1 is a front elevational view in section of a conventional air generated Baum jig.

The present invention is directed to an improved apparatus and process for separating particulate solids according to their differences in specific gravity. The invention employs the use of gravitational pressure head of a fluctuating water and/or liquid column stored in a water/liquid holding means located laterally to and/or above the pulse chamber of a separating cell, wherein said holding means is in fluid communication with the pulse chamber of the separation cell by an inflow/outflow means to generate and regulate water and/or liquid pulsations thereby eliminating the need and/or use of compressed air for pulsation generation. In addition, the invention relates to a method for utilizing a gravitational pressure head of a water and/or liquid column stored in a water and/or liquid holding means located above the pulse chamber of a separation cell, whereby said holding means is in fluid communication with the pulse chamber of the separation jig by an inflow/outflow means to create and control the intensity of the water and/or liquid pulsations which stratify particulate solids of different density in a solids separation jig. Use of a solids separation jig having means for producing and regulating a gravitational pressure head, such as a water and/or liquid holding means located above the pulse chamber of a separation jig wherein said holding means is in fluid communication with the pulse chamber of the separation jig, and inflow means for emitting water and/or liquid from the water and/or liquid column contained in said holding means which in turn allows for the intensity of the water and/or liquid pulsations to adjust to compensate for the changing weight of the solids bed, and outflow means for permitting and regulating the release of water and/or liquid from the separation cell, results in the more efficient separation of granular particles.

More particularly, the present invention eliminates the use of an air chamber and means for supplying compressed air in a standard Baum jig. Substituted therefor, as the means for producing the water and/or liquid pulsations, are (i) a constant water/liquid supply means, such as a pulsation water/liquid feed trough, and (ii) a water/liquid holding means vertically interconnected between said constant supply means and the pulse chamber(s) of the cell(s) of a separation jig, such as a variable-head pulsation water/liquid surge tank, and (iii) means for regulating the flow of water and/or liquid from the water/liquid holding means (i.e. the variable-head pulsation water/liquid surge tank) into and out of the pulse chamber of the jig to produce the water and,,or liquid pulsations.

According to the present invention, an abundant supply of water and/or liquid is stored in a constant water/liquid supply means (i.e. pulsation water/liquid feed trough) located above the separation jig. Water and/or liquid flows at a preset, steady rate from the constant water/liquid supply means (i.e. the pulsation water/liquid feed trough) into the water/liquid holding means (i.e. the variable-head pulsation water/liquid surge tank) through an adjustable control valve such as an adjustable slide gate. The water/liquid holding means (i.e. the variable-head pulsation water/liquid surge tank) is also located above the separation jig in order to produce, through the accumulation of a water and/or liquid column of fluctuating height, the gravitational pressure head necessary to generate water and/or liquid pulsations sufficient to lift and open the particulate solids bed.

Water and/or liquid pulsations are generated by emissions of water and/or liquid under a fluctuating pressure head from the water/liquid holding means (i.e. the variable-head pulsation water/liquid surge tank) into the pulse chamber(s) of the separation jig. A pulsion is generated when water and/or liquid which has accumulated in the water/liquid holding means (i.e. the variable-head pulsation water/liquid surge tank) as a result of the steady flow of water and/or liquid from the constant water/liquid supply means, i.e. the pulsation feed trough, and/or as a result of unused water and/or liquid accumulated during the previous pulsation cycle(s), flows through a means for permitting and/or regulating the inflow of water and/or liquid (such as an inflow valve) into the pulse chamber of the separation jig thereby creating a surge of water and/or liquid through the U-shaped cell, the screen support and the particulate solids bed. The amount of water and/or liquid which is emitted from the water/liquid holding means (i.e. the variable-head pulsation water/liquid surge tank) is a function of the height of the water and/or liquid column in the water/liquid holding means and the resistance of the particulate solids bed. The surge of water and/or liquid will lift and expand the particulate solids bed if the surge of water and/or liquid possesses sufficient gravitational head pressure to overcome the resistance of the particulate solids bed.

When the flow of water and/or liquid from the water/liquid holding means, i.e. the variable-head pulsation water/liquid surge tank, ceases, the water and/or liquid from the pulse chamber(s) of the separation jig then flows out of the cell(s) into a means for storing water and/or liquid, such as a used water/liquid tank through a means for regulating the outflow of water and/or liquid, such as an outflow valve which may or may not be similar to the inflow means, thereby creating a downward drag on the suspended particles in the separation compartment. Adjustable baffle plates located in the used water/liquid tank may also be utilized with the outflow means to control the outflow of water and/or liquid from the separation cell to maintain a sufficient amount of water and/or liquid in the cell to cover the particulate solids bed, and also the rate and amount of outflow which creates the most effective downward current for optimum separation in the separation compartment.

During operation of the present invention, the composition and weight of the particulate solids bed will vary, as described above, because of: (1) variations in the composition of the raw feed stream; and, (2) the gradual accumulation and intermittent removal of heavy particulates under the float near the discharge gate. In order to alleviate problems caused by the varied composition and weight of the particulate solids bed, the present invention does not propose to make the raw feed stream more uniform, nor to change the manner in which the heavy particulates are removed from the solids bed. Rather, the present invention is directed to a method for creating and controlling the intensity of the water and/or liquid pulsations, which is responsive to and will compensate for these unavoidable variations in the composition of the particulate solids bed.

For example, if during the separation process, the particulate solids bed begins to become heavier, it will offer increased resistance to the upward water and/or liquid pulsations, and, as described earlier, less water and/or liquid will pass through the screen support and penetrate the particulate solids bed. According to this invention, under these circumstances the unused water and/or liquid will back up in the water/liquid holding means, i.e. the variable-head pulsation water/liquid surge tank. Water and/or liquid will continue to accumulate over several pulsation cycles, until eventually there will be sufficient gravity head pressure in the water/liquid holding means, i.e. the variable-head pulsation water/liquid surge tank to overcome the increased resistance of the particulate solids bed, and lift and open the particulate solids bed so that efficient separation can be resumed. In this regard, the greater the height of the water and/or liquid column in the water/liquid holding means (i.e. the variable-head pulsation water/liquid surge tank) becomes, the greater the increased gravity head pressure becomes. Because of the increased gravity head pressure, the water and/or liquid pulsations will become more forceful until a sufficient amount of pressure has been built up over repetitive cycles to overcome the resistance of the bed.

Alternatively, during the separation process, if the particulate solids bed begins to become lighter, water and/or liquid will pass more easily through the screen support and the solids bed, and consequently more water and/or liquid will flow from the water/liquid holding means, i.e. the variable-head pulsation water/liquid surge tank. As a result, the water level in the water/liquid holding means, i.e. the variable-head pulsation water/liquid surge tank, will drop over several pulsation cycles. Because of the reduced gravity head pressure, the water/liquid pulsations will become less forceful, allowing the solids bed to settle so that efficient separation can resume. In this manner, a new operating level is established. Thus, gravity head pressure in the water/liquid holding means (i.e. the variable head pulsation water/liquid surge tank) automatically adjusts itself to the increased or the decreased weight of the particulate solids bed.

In this regard, although the solids bed undergoes frequent changes in weight and composition, the changes are normally gradual relative to the solids feed rate, the discharge of the heavy layer, and the cycling time of water and/or liquid pulsations. Hence, adequate response time exists for the water and/or liquid level in the water/liquid holding tank, i.e. the variable-head pulsation water/liquid surge tank, to adjust to the changing conditions.

Furthermore, the water and/or liquid utilized to produce the pressure head may also be recirculated, after being cleaned of particulate matter, if necessary, in static thickeners, ponds, cyclones, or other suitable processes for water and/or liquid clarification. The recirculated water and/or liquid must be substantially free of sizeable solid particles in order to be reused in the present invention.

In addition, it is also possible in the present invention to make appropriate adjustments in the cross-sectional area of the water/liquid holding means, i.e. the variable-head pulsation water/liquid surge tank, for each cell of the jig, in order to achieve optimal control. The cross sectional area may vary from cell to cell, and may also vary with the height of each water/liquid holding means, i.e. the variable-head pulsation water/liquid surge tank. A smaller cross section allows the gravity head pressure to build up more rapidly, whereas a larger cross section is less responsive to changes in the particulate solids bed.

An important object of the present invention is to eliminate the supply of make up water and/or liquid to the jig during the exhaust phase of the pulsation cycle. According to the present invention, make up water and/or liquid is unnecessary since water and/or liquid is supplied through the water/liquid holding means, i.e. the variable-head pulsation water/liquid surge tank. Thus, the particulate solids bed may settle more rapidly and efficiently during the exhaust phase of the pulsation cycle. Although the application of actual suction to enhance the downward current has not been beneficial as reported in the prior art, it may prove beneficial in concert with the present invention, and a means for suctioning off the water and/or liquid to enhance the downward current may be provided.

A further object of this invention is to improve the environmental quality of the workplace by significantly reducing the noise level. According to this invention, air blowers are no longer required to generate water and/or liquid pulsations. Both the blowers and the noise they generate are thus eliminated.

An additional object of this invention is to realize energy efficiencies by replacing the air blowers, currently used to generate the water pulsations, with one or more water pumps. According to the present invention, air blowers are unnecessary. Instead, water and/or liquid will be pumped overhead into the pulsation water/liquid feed trough. Water and/or liquid pumps operate more efficiently than the air blowers currently in use.

A further additional object of this invention is to enhance the separation of extremely high specific gravity solids (specific gravity greater than 1.9). With the prior art methods of using air pressure to generate water pulsations, it has been found that water tends to become trapped above the solids bed because extremely high specific gravity solids tend to fall more quickly to form a more compacted bed with less interstitial space. The detrimental consequences of trapped water and/or liquid will be largely eliminated by the present invention because plenty of fresh water and/or liquid will be available in the water/liquid holding tank, i.e. the variable head pulsation water/liquid surge tank, to generate effective subsequent pulsations. Also, with the current air-generated pulsation method, if the particulate bed becomes lighter for any reason, the necessarily powerful air pulsations are excessively disruptive of the lightened particulate bed. According to the present invention, water and/or liquid pulsations will be more responsive to changes in the high specific gravity feed stream, for example, becoming less forceful in response to a lighter particulate bed.

A further object of this invention is to make the washing of fine particulate feed streams more efficient by providing ample pulsation water and/or liquid to replace the water and/or liquid that is sometimes trapped when the fine solids form a very compact bed, with limited interstitial space for the return of water and/or liquid during the suction phase of the cycle. According to this invention, there will be ample fresh water and/or liquid available from the water/liquid holding means, i.e. the variable head pulsation water/liquid surge tank, to generate adequate water and/or liquid pulsations, despite a reduced return of water and/or liquid through the solids bed.

As is true of the jigging process generally, and the jigging methods and apparatuses found in the prior art, the present invention may be applied to and utilized for the "concentration" of ores as well as the "cleaning" of coal. This invention may be applied to the concentration and/or separation of any particulate solids from other particulates of different specific gravity. Although for convenience, clarity, and illustrative purposes, this writing may refer to the invention as applied to the concentration and/or separation of coal and/or ores, it is in no way intended that this invention be restricted to the separation and/or concentration of any specific material.

In this writing, the fluid in which the particulate body of solids is submerged is often identified as "water", as is customary in the literature as water is the fluid most commonly (although not exclusively) utilized for the suspension of, and upward and downward agitation of, the particles undergoing separation. It is understood among those skilled in the art that additives may be introduced to the water, and that other fluid or liquid may be utilized in the place of water. The use of the term "water" thus is in no way intended to restrict the application of the present invention to utilization with water; the present invention may be utilized with water additives and other fluids and liquids.

In this writing, the support upon which rests the body of particulate solids undergoing separation is often identified as a "perforated screen support" or "screen support". It is understood among those skilled in the art that the support may be of a perforated screen type, may have a meshed or sieved surface, and may utilize ragging. The use of terms such as "perforated screen support" is in no way intended to restrict the application of the present invention to any specific type of support for the body of particulate solids; the present invention may be applied to jigs employing all methods of support for the particulate solids bed.

BRIEF DESCRIPTION OF THE PREFERRED EMBODIMENT

The above brief description, as well as further objects, features, and advantages of the present invention will be more fully understood by reference to the following drawings wherein the showings are for purposes of illustrating the preferred embodiment of the invention only and not for purposes of limiting same.

Figure 4:
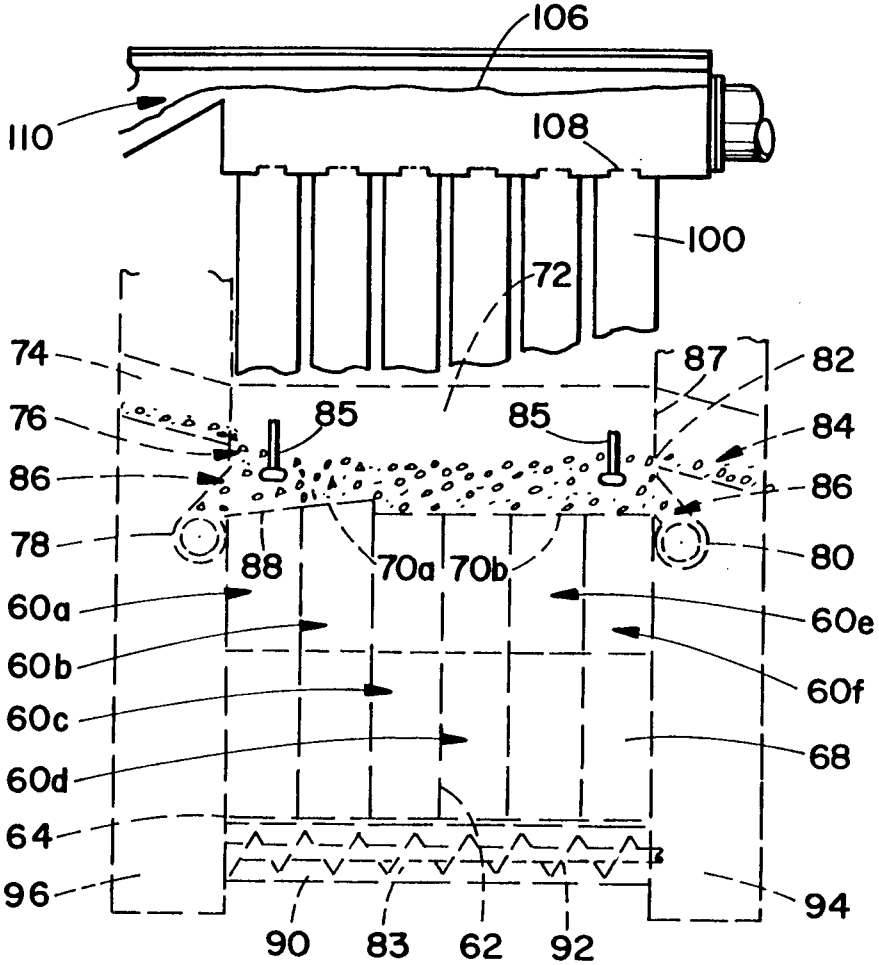
FIG. 4 is a side elevational view of a water/liquid generated pulsation jig of the present invention embodying separate inflow and outflow as viewed from line 3—3 of FIG. 3.
Figure 3:
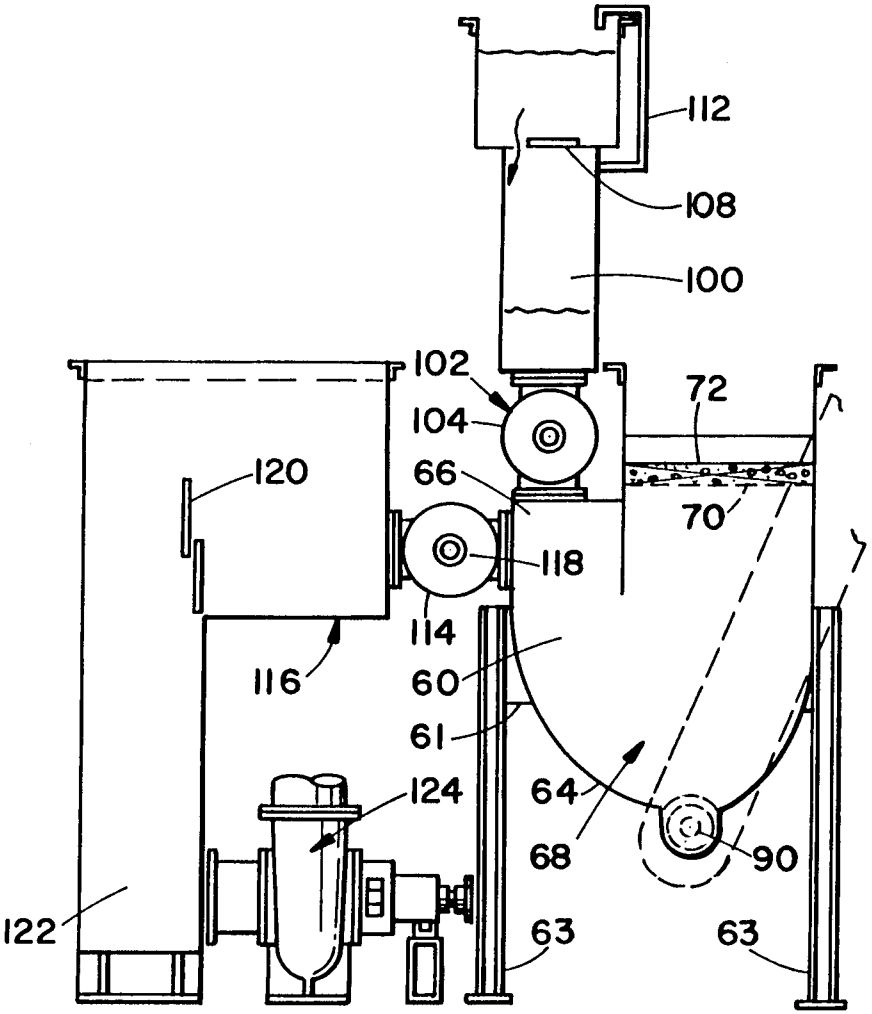
FIG. 3 is a front elevational view of a water/liquid generated pulsation jig of the present invention embodying separate inflow and outflow means.

Referring to FIGS. 3 and 4 in particular, the invention embodied therein, comprises an apparatus and process for separating particulate solids into two or more superposed layers of different density through the action of gravitational force and water and/or liquid generated pulsations. The illustrated water/liquid generated pulsation jig is comprised of one or more individual cells 60, such as cells 60*a*–60*f*, having a "U-tube" shaped construction separated from one another by partitions 62 in a casing 64. Although the casing 64 of cells 60*a*–60*f* may be supported by a number of different means, the casing 64 illustrated in FIGS. 3 and 4 are supported by brackets 61 on supporting sills 63.

As indicated above and in FIG. 3, there may be one or more separating cells utilized in the present invention. The number of cells represented herein are merely for purposes of illustration and not for the purposes of limiting the invention to a particular number of cells.

Each cell 60*a*–60*f* is comprised of a pulse chamber 66, a water/liquid chamber 68, a perforated screen support 70, and a separation chamber 72. Pulse chamber 66, water/liquid chamber 68, and separation chamber 72 of each individual cell 60*a*–60*f* are in fluid communication with one another through the perforated screen of screen support 70. The size of the perforations in screen support 70 varies according to the dimensions of the particulate solids to be separated and/or concentrated. In addition, screen support 70, which separates the water/liquid chamber 68 from separation chamber 72 in each cell 60*a*–60*f* may comprise one or more sub-screen supports 70*a*, 70*b*, etc. which are mounted generally horizontally across the upper portions of water/liquid chambers 68 of cells 60*a*–60*f*. The separation chambers 72 are in fluid communication with one another so that solid particles supported on subscreen supports 70*a*, 70*b*, etc. may flow from cell to cell.

Attached to each end of screen support 70 and/or sub-screen supports 70*a*, 70*b*, etc. are discharge gates 78 and 80 for the heavier refuse particles 86. Screen support 70 and/or sub-screen supports 70*a*, 70*b*, etc. may be horizontal or slightly inclined to accelerate or in some cases to retard the progress of the heavier refuse particles toward their respective discharge gates. A feed port 74, for a body of particulate solids 76 to be separated, is mounted to the upstream end of casing 64 and a discharge weir 82 for the washed product 84 is mounted to the downstream end of casing 64. The discharge of the higher density washed product 86 from the jig may be automated with a float 85 at the discharge gate 80. Float 85 causes discharge gate 80 to open when the body of particulate solids 76 reaches a preset thickness and then closes after evacuation.

The particulate solids bed 76 of granular solids to be separated rests on the screen support 70 which has a meshed or sieved surface, such as a perforated plate, or suitable ragging in case of hutch separations, so that it allows liquid such as water to flow freely through it. The level of pulsation liquid in pulse chamber 66 is sufficient to cover the particulate solids bed 76 present on screen support 70 at all times.

Moreover, on the bottom of the water/liquid chamber 68 there may be one or more rotating screws 90 and 92 which collect small heavy particles that may fall through the openings in the screen support 70. Rotating screws 90 and 92, which may rotate in the same or opposite directions, carry the heavy particles for removal to a removal means such as elevators 94 and 96.

In addition, connected vertically or laterally above each pulse chamber 66 by a water/liquid inflow means 102, is a water/liquid holding means, such as variable-head pulsation water/liquid surge tank 100. Water and/or liquid is supplied to each pulse chamber 66 from variable-head pulsation water/liquid surge tank 100 through inflow means 102. In the water/liquid inflow means 102 of each cell 60*a*–60*f*, there is a variable controlled element 104 which can be regulated during operation to control the release of water and/or liquid from the variable-head pulsation water/liquid surge tank 100 into pulse chamber 66. The variable controlled element 104 used in the illustrated embodiment is a throttle valve suitably programmed to open and close cyclically, i.e. 60 cycles/minute, etc. for the desired intermittent delivery of water and/or liquid into pulse chamber 66. It will be appreciated by those versed in the art that this control may be obtained by conventional mechanical or electrical controllers which cause periodic or cyclic operation.

Furthermore, vertically attached to each variable-head pulsation water/liquid surge tank 100 is a water supply means such as a common pulsation water and/or liquid feed trough 106 which contains an abundant supply of water and/or liquid. Water and/or liquid flows at a preset, steady rate from the pulsation water/liquid feed trough 106 to the variable-head pulsation water/liquid surge tank 100 through an adjustable valve 108. The adjustable valve 108 used in the illustrated embodiment is an adjustable slide gate which can be set to some optimum opening for given operating conditions in order to produce the desired inflow of water and/or liquid.

In order to ensure that the water and/or liquid flow into the variable-head pulsation water/liquid surge tank 100 remains constant, the water and/or liquid level in the pulsation water feed trough 106 must be maintained constant by providing an oversupply of water and/or liquid. The oversupply of water and/or liquid is removed from the pulsation water/liquid feed trough 106 through an overflow 110. The source of water and/or liquid utilized may be either fresh or recycled water as more fully explained below. Moreover, a surge tank vent pipe 112 is present in the pulsation water/liquid feed trough 106 in order to eliminate vacuum formation or air pressure build-up in each of the variable-head pulsation water surge liquid tank(s) 100.

Connected laterally to and/or below each pulse chamber 66 by a water liquid outflow means 114 is a used and/or recirculation water/liquid holding means such as used water/liquid tank 116. Water and/or liquid exits each pulse chamber 66 into the used water/liquid tank 116 through water/liquid outflow means 114. In the water/liquid outflow means 114 is a variable controlled element 118 which can be regulated, either manually, mechanically, or electrically, during operation to control the release of water and/or liquid from pulse chamber 66 into the used water/liquid tank 116. In certain embodiments of the present invention more clearly set forth below, water/liquid outflow means 114 may also operate as water/liquid inflow means 102. In addition, adjustable baffle plates 120 located in the used water/liquid tank 116 may also be set to throttle or, alternatively, to accelerate the outflow of water and/or liquid from pulse chamber 66.

Water and/or liquid utilized in the separation process may be recycled through the collection of water and/or liquid from the used water/liquid tank 116 to a common water/liquid sump 122. In the common water/liquid sump 122, water and/or liquid is recycled, either directly or indirectly through the use of settling ponds, cyclones, and other suitable water and/or liquid clarification means (not pictured) to the pulsation water/liquid feed trough 106 by means of recirculation pump 124 and suitable piping concerning same (not shown).

In order to produce the pulsations of the water and/or liquid flowing into pulse chamber 66 of each of the cells 60*a*–60*f* thereby causing the water and/or liquid level in separation chamber 72 of each cell to rise and fall, in the illustrated embodiment of the invention shown in FIGS. 3 and 4, the inflow and the outflow means 102 and 114, respectively, of each cell are operated alternately. More particularly, when water and/or liquid, which has accumulated in the variable-head pulsation water/liquid surge tank 100 of each cell 60*a*–60*f* as a result of the steady flow of water and/or liquid from the pulsation water/liquid feed trough 106 and/or as a result of a build-up of unused water and/or liquid from previous pulsation cycles, is admitted from the variable-head pulsation water/liquid surge tank 100 into the pulse chamber 66 of each cell 60*a*–60*f* through an open inflow means 102 and a closed outflow means 114, a water and/or liquid pulsation is generated thereby creating a surge of water and/or liquid through each U-shaped cell 60, the screen support 70 and the body of particulate solids 76. If the surge of water and/or liquid possesses a sufficient amount of gravitational force to overcome the resistance of the body of particular solids 76, the surge of water and/or liquid will lift and expand the particulate solids in each separation chamber 72, whereby the lifted and expanded solids may subsequently form stratified layers, with the higher specific gravity particles tending to collect in the lower strata when the water and/or liquid flows downward during the "suction" phase of the cycle as described below.

When the flow of water and/or liquid from each variable-head pulsation water/liquid surge tank 100 into the pulsation chamber 66 ceases, the role of the inflow means 102 and the outflow means 114 reverses with the inflow means 102 closing and the outflow means 114 opening. Water and/or liquid present in each cell then flows out of the pulse chamber 66 into a used water/liquid tank 116 through an opened outflow means 114 of each cell 60*a*–60*f* thereby creating a downward drag on the suspended particles in each separation compartment 72 and causing the stratification of the particles according to their specific densities. Adjustable baffle plates 120 located in the used water/liquid tank 116 may also be utilized with outflow means 114 to control the outflow of water and/or liquid from the cell so that a sufficient amount of water and/or liquid remains in each cell to cover the body of particulate solids 76 and so that an enhanced downward current for optimum separation is achieved. The used water and/or liquid may then be recycled for subsequent use through the common water/liquid sump 122, water/liquid sump pump 124, and other clarification means and piping (not pictured) to the pulsation water/liquid feed trough.

If, however, the surge of water and/or liquid from any and/or all of the variable-head pulsation water/liquid surge tank(s) 100 fail to possess a sufficient amount of gravitational force to overcome the resistance of the body of particulate solids 76 present in cells 60*a*–60*f*, little or no water and/or liquid from the corresponding variable head pulsation water/liquid surge tank 100 enters the pulse chamber 66 of the respective cell. The amount of water and/or liquid entering the pulse chamber 66 is minimal until an adequate amount of water and/or liquid backs up as a result of subsequent pulsation attempts into the respective variable-head pulsation water/liquid surge tank 100 to produce a gravitational force sufficient enough to overcome the resistance of the body of particulate solids 76.

As indicated above, the present invention is responsive to and will compensate for variations in the composition of the body of particulate solids 76. As the body of particulate solids 76 becomes heavier, the heavier bed offers increased resistance to water and/or liquid flow through the inflow means 102 producing a build up of water and/or liquid in the variable-head pulsation water/liquid surge tank 100 until there is sufficient water and/or liquid head pressure in the variable head pulsation water/liquid surge tank 100 to match the increased resistance, thereby permeating and lifting the body of particulate solids 76 during the rising (i.e. "pulsion") current for effective separation during the falling (i.e. "suction") current. Alternatively, as the body of particulate solids becomes lighter, the lighter bed offers decreased resistance to the flow of water and/or liquid through the inflow means 102 and more water and/or liquid will flow into the cell until the water and/or liquid level in the variable-head pulsation water/liquid surge tank 100 drops sufficiently for effective separation.

As a result of the water and/or liquid pulsation produced in the present invention, the body of particulate solids 76 present in the separation chamber 72 will separate and stratify into a heavier density particle layer 86 and a lighter density particulate layer 84. The heavier particulate layer 86 is removed by discharge gates 78 and 80 while the lighter floats product layer 84 is removed, with water and/or liquid, by flowing out discharge gate 87. In addition, the fine heavy particles 83 that fall through the openings in the screen support 70 and settle onto the bottom of the water/liquid chamber 68 are carried out of the cell by rotating screws 90 and 92 for removal by elevators 94 and 96 or other means such as a spigot (not pictured).

Figure 5:
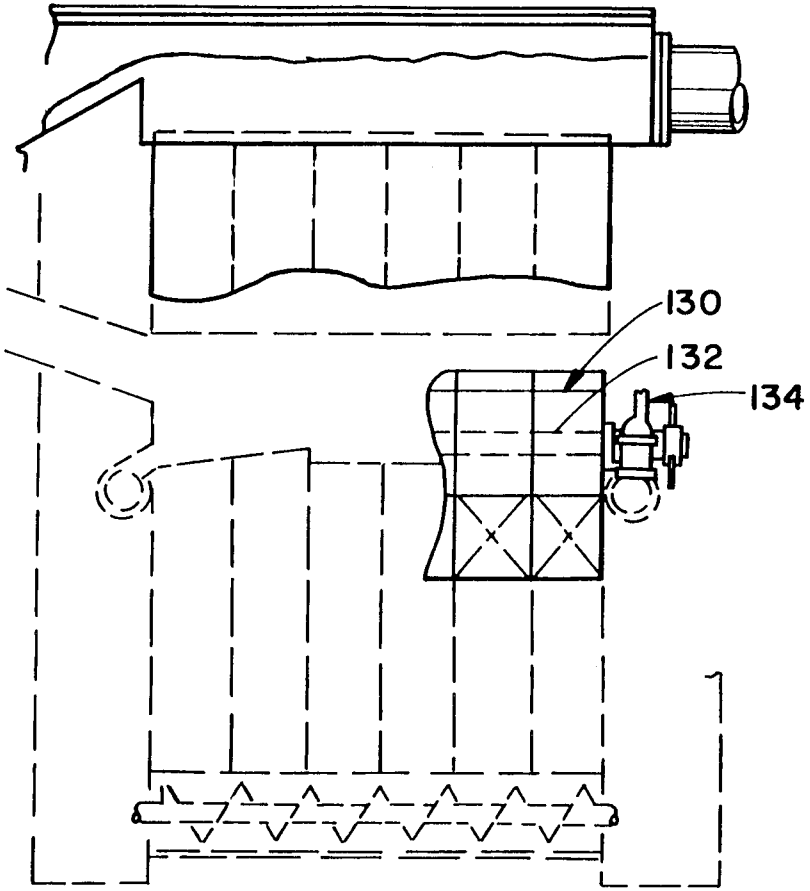
FIG. 5 is a front elevational view of a water/liquid generated pulsation jig of the present invention embodying a single inflow/outflow means.

FIGS. 5 and 6 are directed to an alternative embodiment of the present invention wherein both the inflow means 102 and the outflow means 114 for each cell are present in a single inflow/outflow means, such as a pulsation water/liquid rotary valve 130, for regulating the flow of water and/or liquid into and out of each cell 60*a*–60*f* of the separation jig. The rotary valves 130 of the cells are arranged sequentially and are driven by a common drive shaft 132 by a bearing 134, and by a motor means (not pictured) which may be mechanically or electrically controlled to operate at a set rate, for example, 60 cycles/minute. Rotary valve 130 permits both the inflow of water and/or liquid into each pulse chamber 66 from each variable-head pulsation water/liquid surge tank 100, and the outflow of water and/or liquid from each pulse chamber 66 to a used water/liquid tank 116, thereby creating the water and/or liquid generated pulsations produced by the gravitational pressure head of water and/or liquid present in the variable-head pulsation water/liquid surge tank 100 of each cell 60*a*–60*f*.

Figure 7:
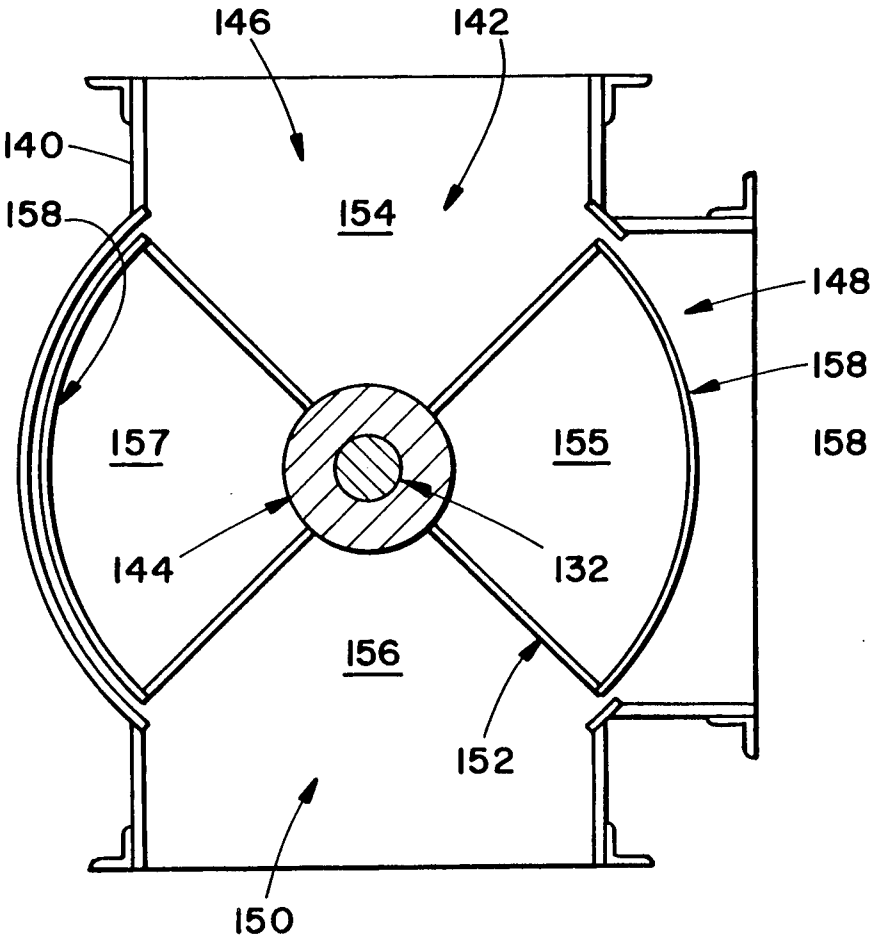
FIG. 7 is an enlarged sectional view illustrating the single inflow/outflow means of the present invention.

The specific components of the rotary valves 130 utilized in the alternative embodiment of the invention are illustrated in detail in FIG. 7. Each valve comprises a housing 140 having an internal chamber in which a star type rotor 144 is mounted for rotation on the common drive shaft 132. The housing 140 is provided with an inlet port 146, an inflow/outflow port 148 and an outlet port 150, wherein the inlet port 146 is in fluid communication with the water/liquid holding means such as the variable-head pulsation water/liquid surge tank 100, the inflow/outflow port 148 is in fluid communication with the pulse chamber 66 and the outlet port 150 is in fluid communication with the used water/liquid holder 116. The star type rotor 144 in the illustrated embodiment is supported on the shaft 132 with four radially mounted wall means such as pallets 152 at 90° intervals that divide the internal chamber 142 into four separate equal sectors 154–157. Two opposing sectors, 155 and 157, are sealed by an arc-shaped cover 158 of metal between the pallets 152 to prevent the inflow and/or transportation of fluid. Sections 155 and 157 are referred to as the "blind sections". The other two sections 154 and 156, are open and allow for the flow or transportation of fluid. Sections 154 and 156 are referred to as the "open sections".

FIGS. 6A–6E illustrate the operation of the rotary valve 130 in relationship to the water and/or liquid level in the variable-head pulsation water/liquid surge tank 100 and the resistance of the particulate solids bed 76 of granular solids to be separated which are resting on screen support 70. The shaft 132 and the pallets 152 rotate in a clockwise direction at a predetermined set speed of operation. For every 360° turn of the shaft 132, two water and/or liquid pulsation cycles are generated with the four pallet rotary valve 130.

Figure 13:
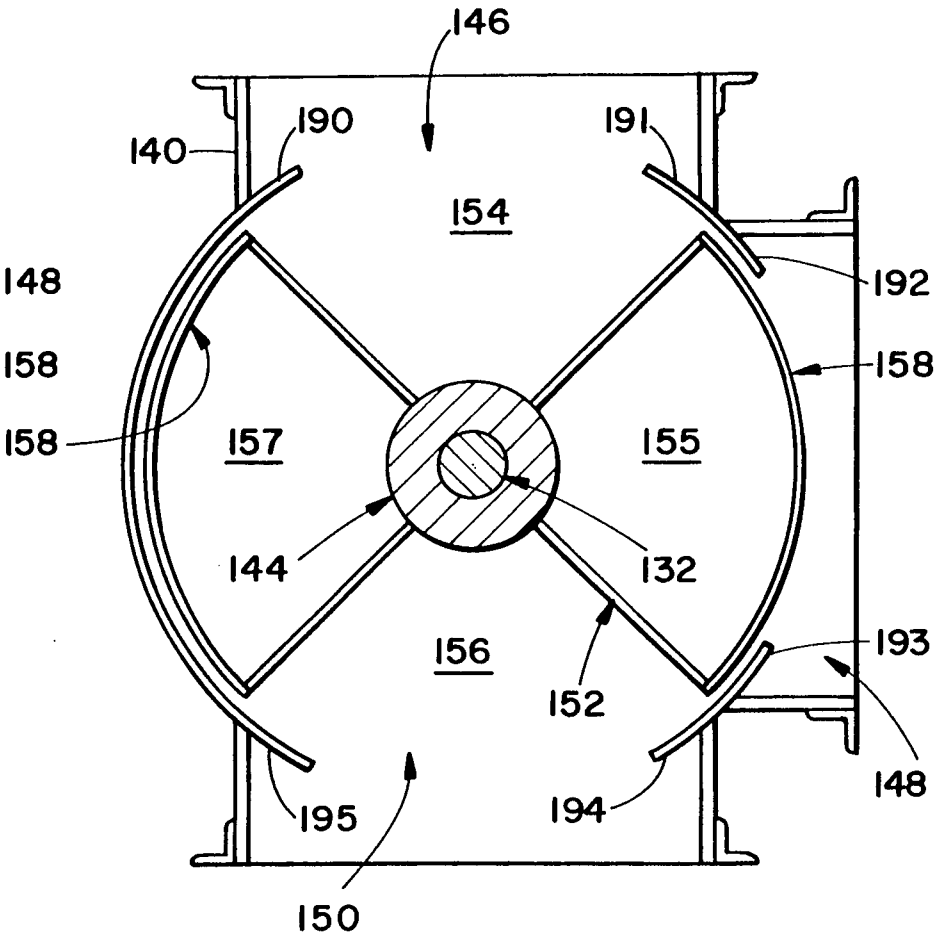

FIG. 13 illustrates that the various ports of the rotary valve 130, i.e. ports 146, 148, and/or 150, may be partially covered by adjustable covers 190–195 which are attached to the housing 140 of the rotary valve 130 by suitable affixing means to regulate the flow of fluid through the ports. By regulating the flow of fluids through the ports, the adjustable covers 190–195 diminish the effective 90° arc of the rotary valve 130 if the effective diminishment is beneficial to enhance separation by altering certain characteristics of the pulsion-suction cycle, such as creating a shorter pulsion time relative to the suction time, or causing an interval of time to elapse between the end of the pulsion phase and the beginning of the suction phase in the pulsion-suction cycle.

Figure 6A:
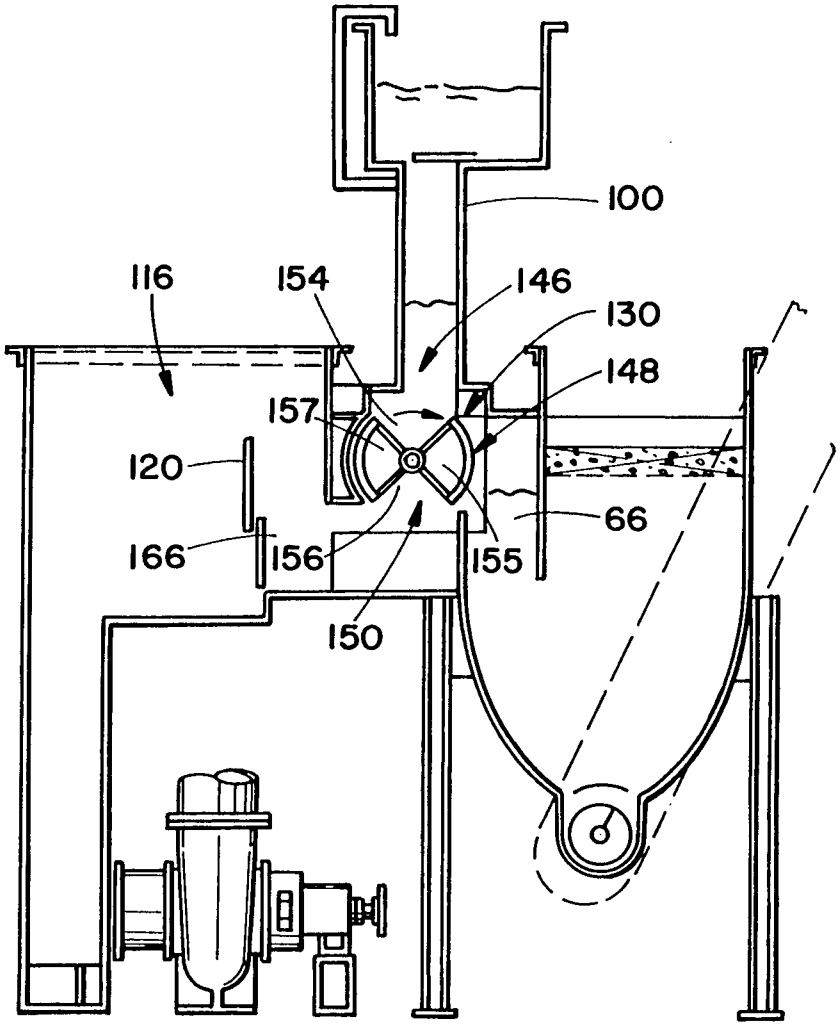
FIGS. 6A-6E are side elevational views of a water/-liquid generated pulsation jig of the present invention embodying a single inflow/outflow means.

The cycle begins with an open sector, such as open section 154, receiving water and/or liquid from the variable-head pulsation water/liquid surge tank 100 through the inlet port 146, and a blind sector, such as blind sector 155, sealing off the inflow/outflow port 148 leading to the pulse chamber 66 of the cell (FIG. 6A). At this point, (1) the water and/or liquid level in the variable-head pulsation water/liquid tank 100 is anywhere within its normal operating parameters; (2) the water and/or liquid level in pulse chamber 66 is at its lowest point in the pulsion-suction cycle as a result of the water and/or liquid evacuation that occurred in the previous cycle; and (3) the water and/or liquid level in the separation chamber 72 is at its lowest point in the pulsion-suction cycle although it must remain high enough to cover the particulate solids bed 76 by proper adjustment of outflow baffle plates 120. Each of these parameters may be higher or lower at the corresponding point the next cycle.

As the shaft 132 turns, the rotary valve 130 turns so that the open sector 154 begins to release water and/or liquid, which has accumulated in the variable-head pulsation water/liquid surge tank 100 of each cell 60*a*–60*f* as a result of the steady flow of water and/or liquid from the pulsation feed trough 106 and/or as a result of a build-up of unused water and/or liquid from previous pulsation cycles, into pulse chamber 66 through the inflow/outflow port 148 (FIG. 6B) thereby allowing the variable-head pulsation water/liquid surge tank 100 to be in fluid communication with the pulse chamber 66 of the cell to create the pulsion phase of the cycle. The gravitational pressure head of the water and/or liquid column present in the variable-head pulsation water/liquid surge tank 100 forces water and/or liquid through the inflow/outflow port 148 into the pulse chamber 66 thereby creating a surge of water and/or liquid through each U-shaped cell 60*a*–60*f*, screen support 70 and the body of particulate solids 76. If the surge of water and/or liquid is emitted subject to a sufficient amount of gravitational force to overcome the resistance of the body of particulate solids 76, the surge of water and/or liquid will properly lift and expand the particulate solids in each separation chamber 72.

Figure 8:
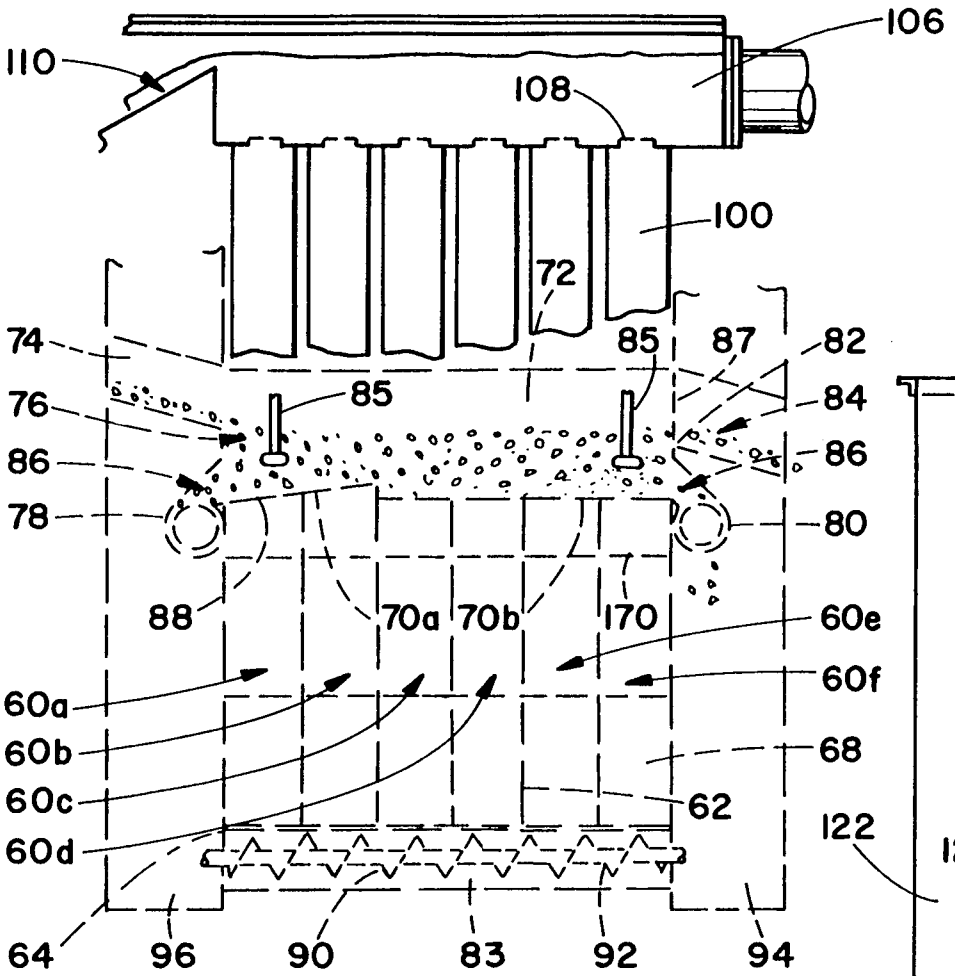
FIG. 8 is a front elevational view of a water/liquid generated pulsation jig of the present invention embodying separate inflow and outflow means and a dispersion arrangement mounted beneath the sieve or screen support.

During the pulsion phase of the cycle, the overall water and/or liquid level in the variable-head pulsation water/liquid surge tank 100 normally drops even though water and/or liquid is always being supplied at a constant rate from the pulsation water/liquid feed trough 106 (see FIG. 8). This is because during the pulsion phase of the cycle, the overall rate at which water and/or liquid flows into the pulse chamber 66 from the variable-head pulsation water/liquid surge tank 100 is generally greater than the rate of water and/or liquid flowing from the pulsation water/liquid feed trough 106 into the variable-head pulsation water/liquid surge tank 100.

If the gravitational pressure of the water and/or liquid present in the variable-head pulsation water/liquid surge tank 100 is sufficient to overcome the resistance of the body of particulate solids 76, the water and/or liquid level in the separation chamber 72 also rises as water and/or liquid flows up through the particulate solids bed 76 thereby lifting and opening the bed for separation and/or stratification. If, however, the surge of water and/or liquid from the variable-head pulsation water/liquid surge tank 100 fails to possess a sufficient amount of gravitational force to overcome the resistance of the body of particulate solids 76, little or no water and/or liquid from the corresponding variable-head pulsation water/liquid surge tank 100 enters the pulse chamber 66 of the respective cells. The amount of water and/or liquid entering the pulse chamber 66 of each cell is minimal until an adequate amount of water and/or liquid backs up in the respective variable-head pulsation water/liquid surge tank(s) 100 as a result of subsequent pulsation attempts to produce a gravitational force sufficient enough to overcome the resistance of the body of particulate solids 76. Finally, if the gravity pressure head of the water/liquid column in the variable-head pulsation water/liquid surge tank 100 is excessive in relation to the condition of the body of particulate solids 76, the flow of water and/or liquid from the corresponding variable-head pulsation water/liquid surge tank 100 to the pulse chamber 66 will be somewhat excessive. However, the excess water and/or liquid will quickly drain out of the variable head pulsation water/liquid surge tank as the decreased height of the water and/or liquid column reaches a level appropriate to the resistance of the body of particulate solids 76.

Figure 6C:
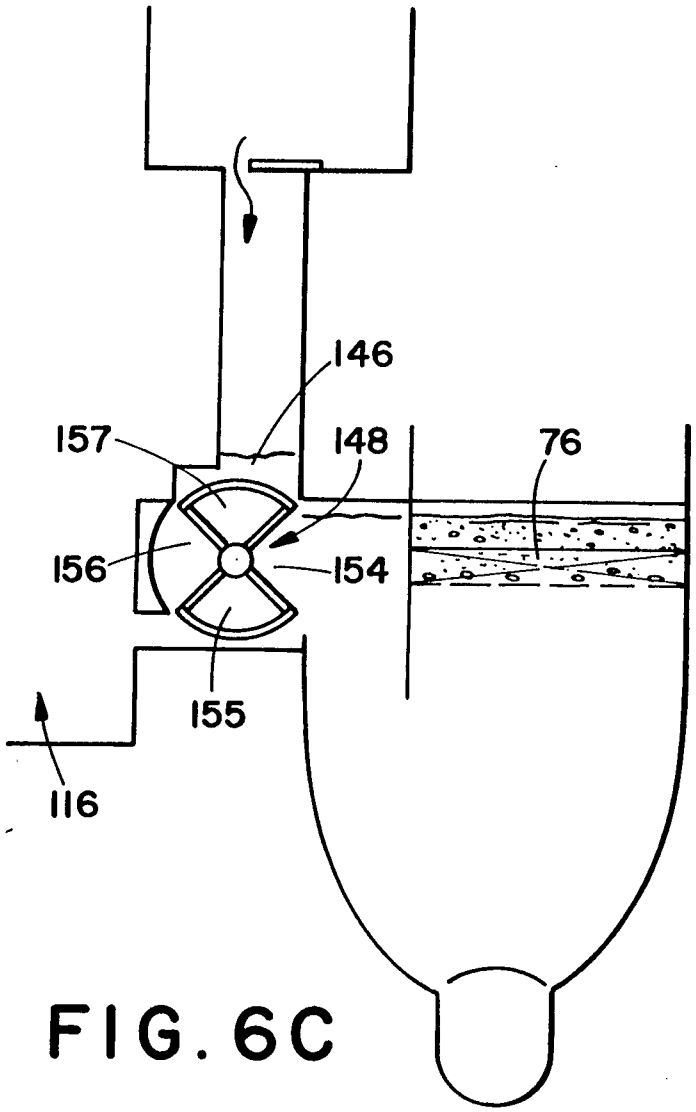
Figure 6B:
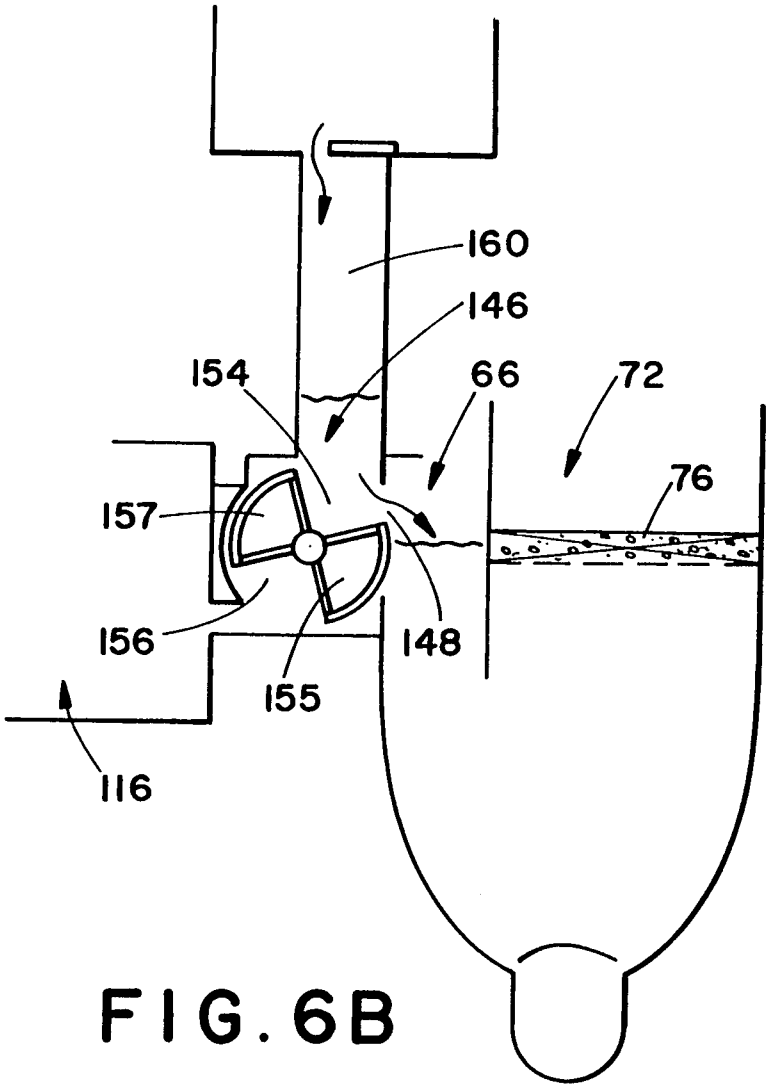

When the rotary valve 130 has completed a quarter turn, i.e. has turned 90°, the open sector 154 is completely open through the inflow/outflow port 148 to the pulse chamber 66 of the cell, and the inlet port 146 and the corresponding variable-head pulsation water/liquid surge tank 100 are sealed off for fluid flow by the blind sector 157 (FIG. 6C). At this point, (1) the water and/or liquid level in the variable head pulsation water/liquid surge tank 100 is at its lowest point in this particular pulsion-suction cycle, and is within normal operating parameters (it may be higher or lower at a corresponding point in the next cycle, depending on the conditions of the particulate solids bed 76); (2) the water and/or liquid level in the separation chamber 72 is at its maximum level in the pulsion-suction cycle (it may be higher or lower at a corresponding point in the next cycle); and (3) the particulate solids bed is at its maximum expansion for the pulsion-suction cycle (of course, the solids bed may expand more or less at the corresponding point in the next cycle).

Figure 6E:
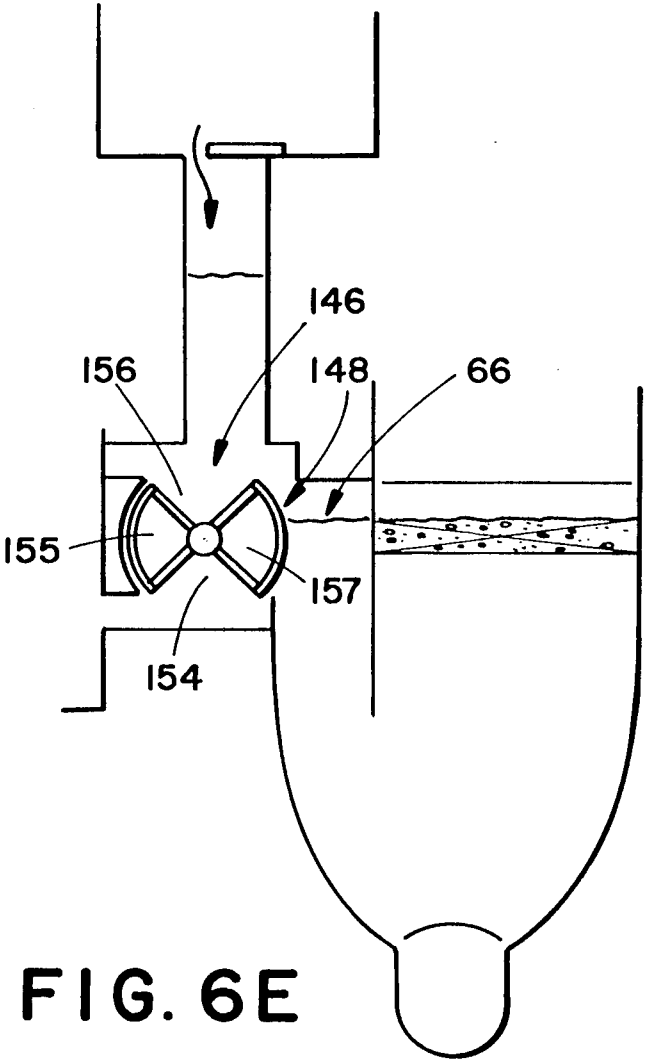
Figure 6D:
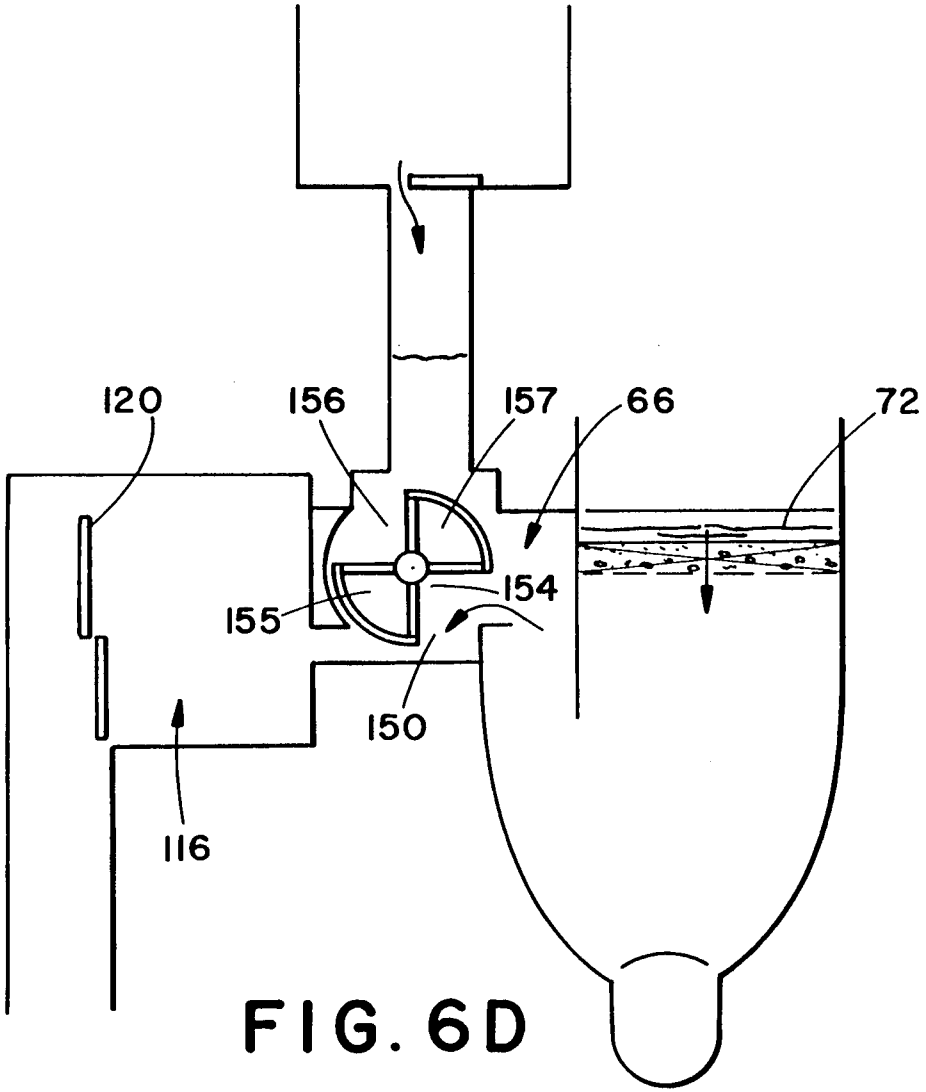

As the rotation of rotary valve 130 continues, the open sector 154 turns toward the used water/liquid holder 116 to discharge water and/or liquid from the pulse chamber 66 of the cell through outlet port 150 to create the suction phase of the cycle (FIG. 6D). Adjustable baffle plate 120 located in the used water/liquid tank 116 may also be utilized with rotary valve 130 to control the outflow of water and/or liquid from the cell so that a sufficient amount of water and/or liquid remains in each cell to cover the body of particulate solids 76 present on screen support 70 and so that an optimum downward current for optimum separation is achieved. During the suction phase of the cycle, (1) the water and/or liquid level in the variable-head pulsation water/liquid surge tank 100 is increasing at a steady rate because water and/or liquid is flowing thereinto at an even flow from the pulsation feed trough 106; (2) the water and/or liquid level in the pulse chamber 66 may drop a little, but the pulse chamber 66 remains essentially full of water and/or liquid as water and/or liquid flows out of the jig through outlet port 150 of the rotary valve 130; and, (3) the water and/or liquid level in the separation chamber 72 is dropping as water and/or liquid flows down through the particulate solids bed 76, although, as described above, the water and/or liquid level must remain sufficient to cover the bed of particulate solids 76.

Upon completion of a half turn (i.e. 180° turn) of the rotary valve 130, one pulsation cycle has been generated. The blind sector 157 seals off the inflow/outflow port 148 leading to the pulse chamber 66 of the cell thereby preventing the loss of an excessive amount of water and/or liquid (FIG. 6E). An alternative open sector 156, as opposed to the open sector 154 utilized in the first cycle, is now available to receive water and/or liquid from the variable-head pulsation water/liquid surge tank 100 through the inlet port 146 to generate the pulsion phase of the second cycle.

Figure 9:
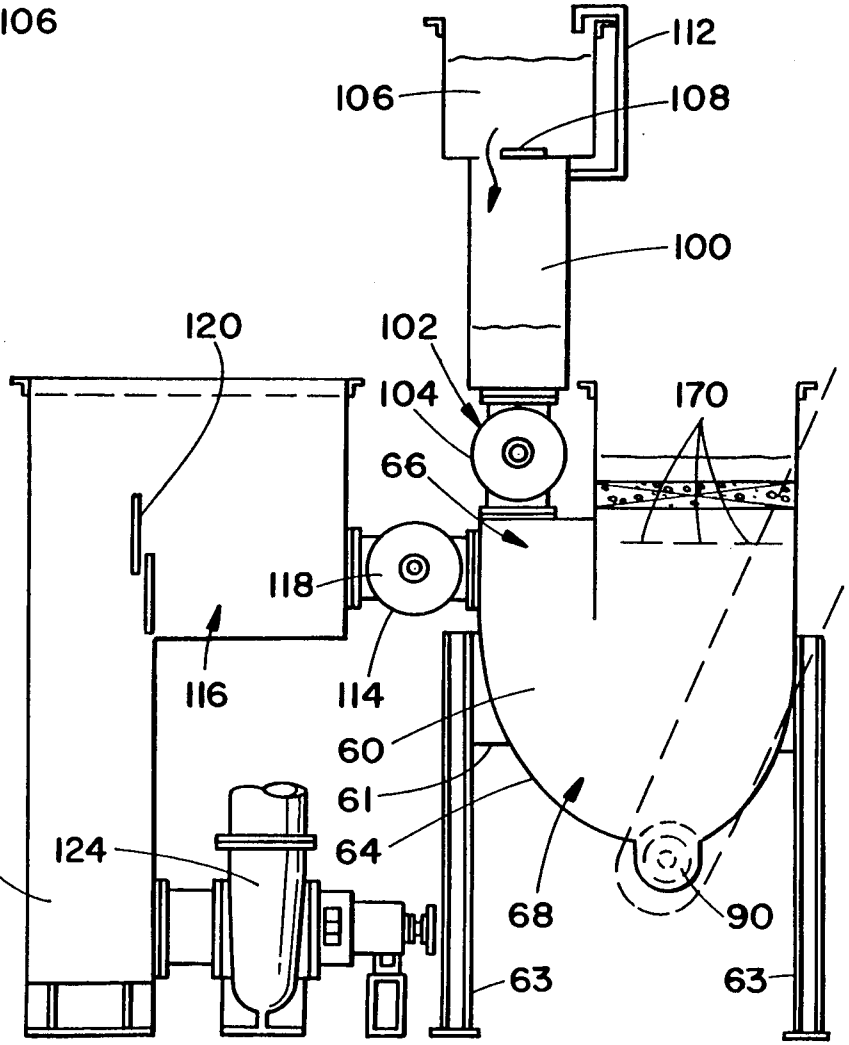
FIG. 9 is a side elevational view of a water/liquid generated pulsation jig of the present invention embodying separate inflow and outflow means and a dispersion arrangement mounted beneath the sieve or screen support.

FIGS. 8 and 9 are directed to an alternative embodiment of the present invention which is in all respects similar to the embodiment described above with reference to FIGS. 3 and 4 except that a dispersion arrangement 170 is mounted beneath the perforated screen support 70 to more evenly distribute the force of the pulsion current across the screen support 70 and the bed of particulate solids 76.

Figure 11:
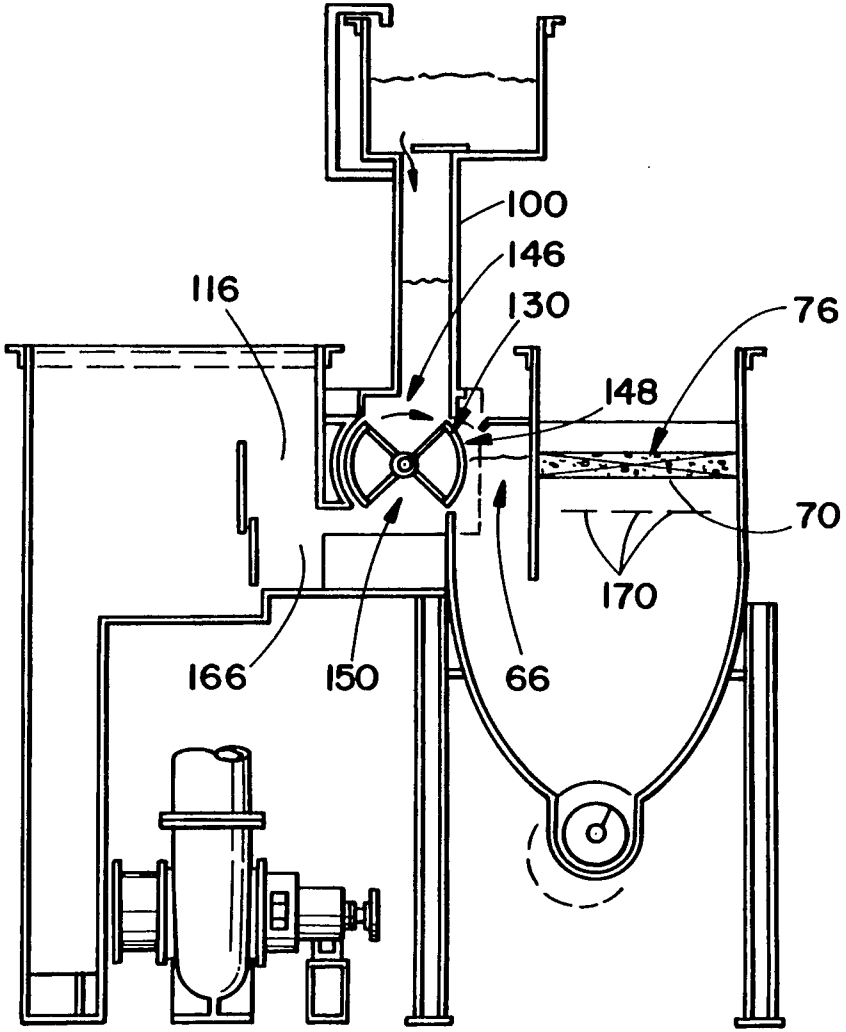
FIG. 11 is a side elevational view of a water/liquid generated pulsation jig of the present invention embodying a single inflow and outflow means and a dispersion arrangement mounted beneath the sieve or screen support.
Figure 10:
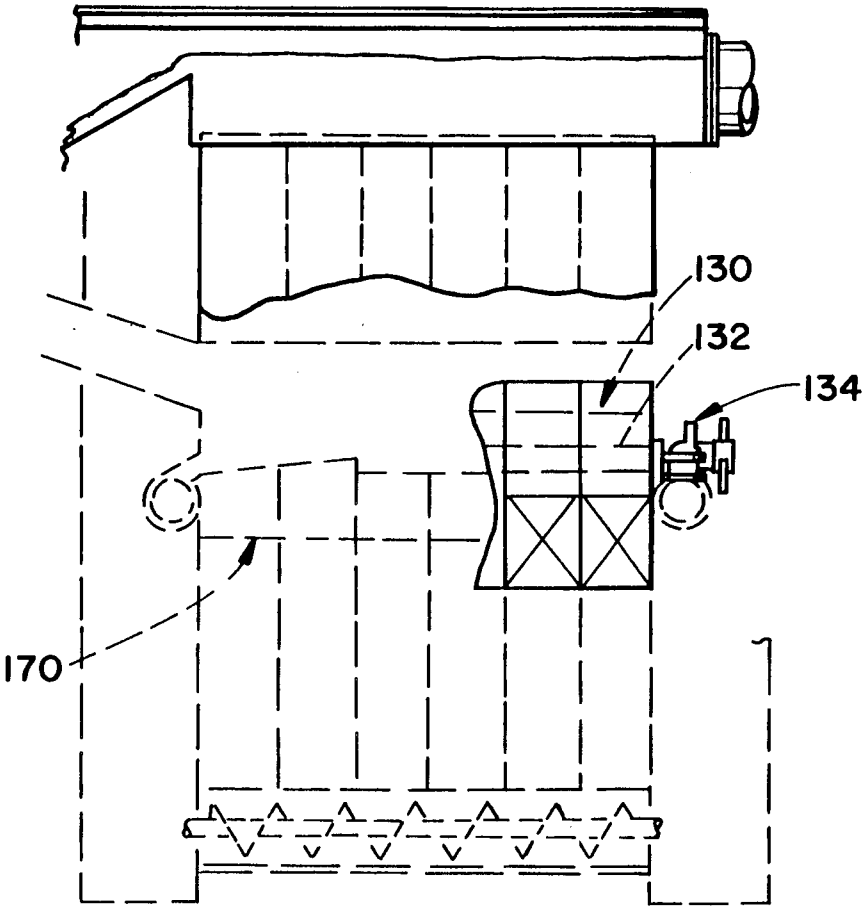
FIG. 10 is a front elevational view of a water/liquid generated pulsation jig of the present invention embodying a single inflow and outflow means and a dispersion arrangement mounted beneath the sieve or screen support.

FIGS. 10 and 11 are directed to an alternative embodiment of the present invention which is in all respects similar to the embodiment described above with reference to FIGS. 5 and 6 except that a dispersion arrangement 170 is mounted beneath the perforated screen support 70 to more evenly distribute the force of the pulsion current across the screen support 70 and the bed of particulate solids 76.

Figure 12:
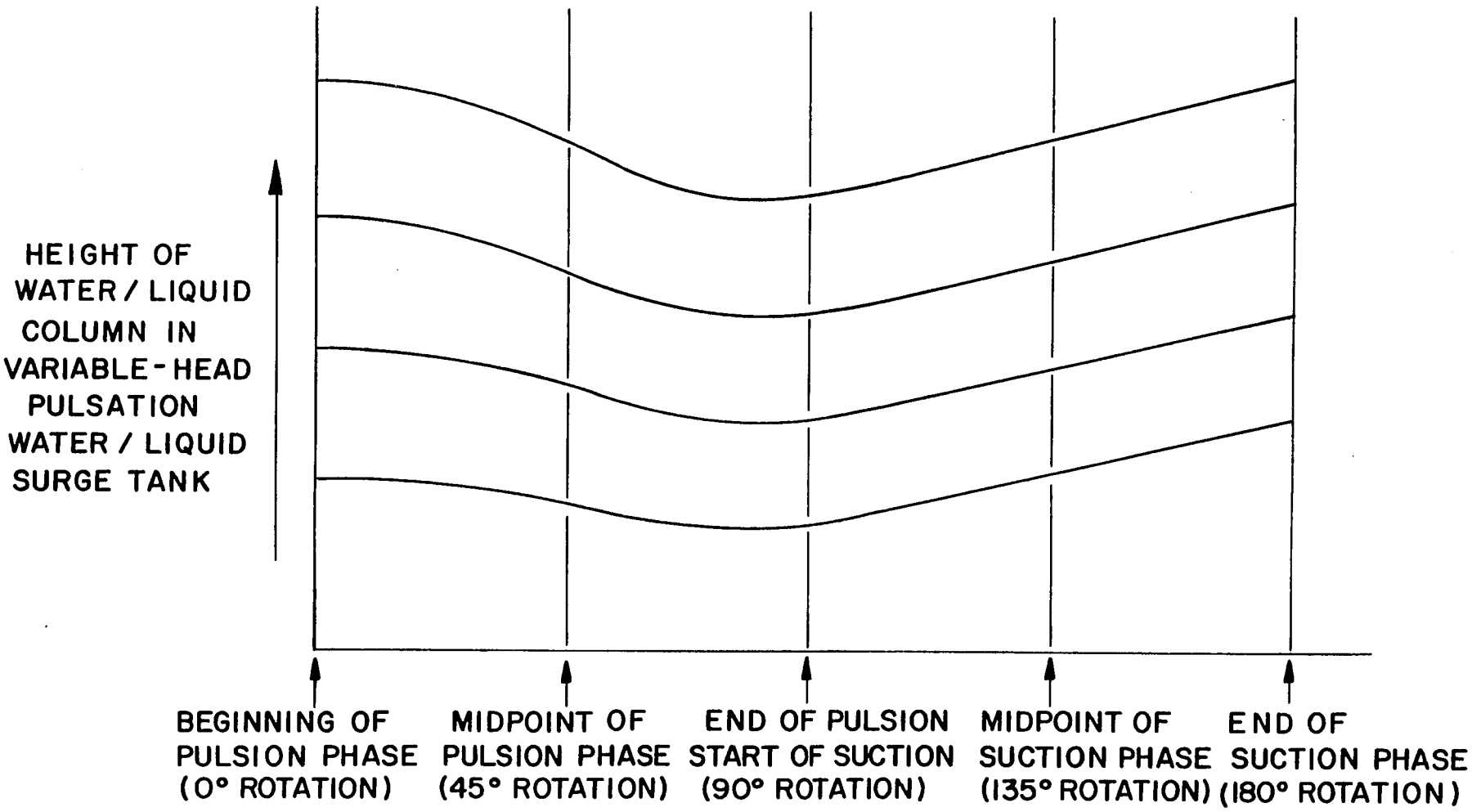
FIG. 12 is a graph showing the generalized relationship of the height of the water/liquid column in the water/liquid holding means at various degrees of rotation of the rotary valve; and, FIG. 13 is an enlarged sectional view illustrating the single inflow/outflow means of the present invention having adjustable cover means in the ports for regulating fluid flow.

FIG. 12 illustrates the general relationship between the height of the water/liquid column in the variable-head pulsation water/liquid surge tank over the course of a single pulsation (i.e. pulsion-suction) cycle. As can be seen, the height of the water/liquid column drops in a non-linear manner during the pulsion phase of the cycle as water/liquid is emitted from the variable-head pulsation water/liquid surge tank from the pulsation water/liquid feed trough. The height of the water/liquid column steadily increases during the suction phase of the cycle as a result of the steady flow of water/liquid into the variable-head pulsation water/liquid surge tank from the pulsation water/liquid feed trough. This generalized relationship applies to each of the embodiments described above.

The present invention is directed to an improved apparatus and process for separating particulate solids according to their differences in specific gravity. The present invention can be successfully employed as indicated above, for processing and concentrating any solids particles, such as coal or mineral ores, from other particles of different specific gravity.

The invention has been described with reference to the preferred embodiment. Obviously, modifications and alterations will occur to others upon a reading and understanding of the specification. It is intended to include all such modifications and alterations insofar as they come within the scope of the appended claims or the equivalents thereof.

Having thus described the preferred embodiments, the invention is now claimed to be:

1. An apparatus for separating particulate solids according to differences in their specific gravities through the use of water generated pulsation cycles, comprising:

at least one separation cell having a pulse chamber that receives water that generates a water pulsation, a water chamber for transferring the generated water pulsation, a perforated screen support for supporting particulate solids, and a separation chamber for separating the particulate solids according to differences in their specific gravities, wherein said pulse chamber, said water chamber, and said separation chamber are in fluid communication with one another through the perforations of said perforated screen support;

means for feeding the particulate solids to be separated onto said perforated screen support;

at least one water holding means extending laterally of and above said pulse chamber, wherein said water holding means is exposed to the surrounding atmosphere and stores unused water accumulated from previous pulsation cycles and water supplied at a preset rate from a water supply means to produce a water column possessing a gravitational pressure head that is fluctuating and responsive to changing conditions in the bed of particulate solids, with the gravitational pressure head increasing as the bed of particulate solids becomes heavier, and with the gravitational pressure head decreasing as the bed of particulate solids becomes lighter;

an inflow means connected between said water holding means and said pulse chamber for permitting the inflow of said stored water from the water holding means into the pulse chamber, thereby allowing for the stored water from the water holding means to enter into the pulse chamber to produce a water pulsion in the separation cell whenever the gravitational pressure head of the stored water from the water holding means is sufficient to overcome the resistance of the particulate solids supported on the screen support, with the intensity of the water pulsion fluctuating and responsive to changing conditions in the bed of particulate solids, responding in due course to a heavier bed of particulate solids with more intense water pulsions, and responding in due course to a lighter bed of particulate solids with less intense water pulsions;

an outflow means connected laterally of or below said pulse chamber of said separation cell for permitting the outflow of water from the separation cell, wherein, said outflow means is regulated alternately to said inflow means to produce water pulsations in the separation cell; and, means for removing the separated solids produced by the water pulsations from the separation cell.

2. The apparatus of claim 1, wherein the size of the perforations in the perforated screen support varies according to the dimensions of the particulate solids to be separated.

3. The apparatus of claim 1, wherein the perforated screen support comprises one or more sub-screen supports.

4. The apparatus of claim 1, wherein the means for removing the separated solids produced by the water pulsations from the separation cell are discharge gates.

5. The apparatus of claim 4, further comprising a float for regulating the discharge gates.

6. An apparatus for separating particulate solids according to differences in their specific gravities through the use of water generated pulsation cycles, comprising:

at least one separation cell having a pulse chamber that receives water that generates a water pulsation, a water chamber for transferring the generated water pulsation, a perforated screen support for supporting particulate solids, and a separation chamber for separating the particulate solids according to differences in their specific gravities, wherein said pulse chamber, said water chamber, and said separation chamber are in fluid communication with one another through the perforations of said perforated screen support;

a means for feeding the particulate solids to be separated onto said perforated screen support;

at least one water holding means extending laterally of and above said pulse chamber, wherein said water holding means is exposed to the surrounding atmosphere and stores unused water accumulated from previous pulsation cycles and water supplied at a preset rate from a water supply means to produce a water column possessing a gravitational pressure head that is fluctuating and responsive to changing conditions in the bed of particulate solids, with the gravitational pressure head increasing as the bed of particulate solids becomes heavier, and with the gravitations pressure head decreasing as the bed of particulate solids becomes lighter;

at least one used water holding means extending laterally of and below said pulse chamber, wherein said used water holding means channels used water from said pulse chamber; and an inflow/outflow means connected between said water holding means, said pulse chamber, and said used water holding means, wherein said inflow/-outflow means permits the inflow of said stored water from the water holding means into the pulse chamber of the separation cell to produce a water pulsion in the separation cell whenever the gravitational pressure head of the stored water from the water holding means is sufficient to overcome the resistance of the particulate solids supported on the screen support, with the intensity of the water pulsion fluctuating and responsive to changing conditions in the bed of particulate solids, responding in due course to a heavier bed of particulate solids with more intense water pulsions, and responding in due course to a lighter bed of particulate solids with less intense water pulsions, and wherein said inflow/outflow means alternately permits the outflow of water from the pulse chamber of the separation cell into the used water holding means to complete the water pulsation cycle in the separation cell.

7. The apparatus of claim 6, wherein the size of the perforations in the perforated screen support varies according to the dimensions of the particulate solids to be separated.

8. The apparatus of claim 6, wherein the perforated screen support comprises one or more sub-screen supports.

9. The apparatus of claim 6, wherein the means for removing the separated solids produced by the water pulsations from the separation cell are discharge gates.

10. The apparatus of claim 9, further comprising a float for regulating the discharge gates.

11. The apparatus of claim 6, wherein said inflow/-outflow means comprises a rotary valve having a housing, and an internal chamber in which a rotor is mounted for rotation on a drive shaft, wherein said housing is provided with an inlet port which is in fluid communication with the water holding means, an inflow/outflow port which is in fluid communication with the pulse chamber, and an outlet port which is in fluid communication with the used water holding means, and wherein said rotor comprises a first wall means, a second wall means, a third wall means, and a fourth wall means mounted at equal 90° intervals on said drive shaft to form four separate sectors wherein an arc-shaped cover is connected between the first and the second wall means and between the third and the fourth wall means to form alternative blind sectors which prevent fluid flow and wherein the remaining sectors formed by the second and the third wall means and the fourth and the first wall means are open for fluid communication.

12. The rotary valve of claim 11, further comprising adjustable covers attached to the housing of said rotary valve in a manner suitable to regulate the flow of water through said ports.

13. The apparatus of claim 6, wherein said inflow/-outflow means comprises a rotary valve having a housing, an internal chamber in which a rotor is mounted for rotation on a drive shaft, wherein said housing is provided with an inlet port which is in fluid communication with the liquid holding means, an inflow/outflow port which is in fluid communication with the pulse chamber, and an outlet port which is in fluid communication with the used liquid holding means, and wherein said rotor comprises a first wall means, a second wall means, a third wall means, and a fourth wall means mounted at equal 90° intervals on said drive shaft to form four separate sectors wherein an arc-shaped cover is connected between the first and the second wall means and between the third and the fourth wall means to form alternative blind sectors which prevent fluid flow and wherein the remaining sectors formed by the second and the third wall means and the fourth and the first wall means are open for fluid communication.

14. The rotary valve of claim 13, further comprising adjustable covers attached to the housing of said rotary valve in a manner suitable to regulate the flow of liquid through said ports.

15. A process for separating particulate solids according to differences in their specific gravities through the use of water generated pulsation cycles, comprising the steps of:

feeding the particulate solids to be separated into an apparatus containing at least one separation cell having a pulse chamber that receives water that generates a water pulsation, a water chamber for transferring the generated water pulsation, a perforated screen support for supporting particulate solids, and a separation chamber for separating the particulate solids according to differences in their specific gravities, wherein said pulse chamber, said water chamber, and said separation chamber are in fluid communication with one another through the perforations of said perforated screen support; means for feeding the particulate solids to be separated onto said perforated screen support; at least one water holding means extending laterally of and above said pulse chamber, wherein said water holding means is exposed to the surrounding atmosphere and stores unused water accumulated from previous pulsation cycles and water supplied at a preset rate from a water supply means to produce a water column possessing a gravitational pressure head that is fluctuating and responsive to changing conditions in the bed of particulate solids, with the gravitational pressure head increasing as the bed of particulate solids becomes heavier, and with the gravitational pressure head decreasing as the bed of particulate solids becomes lighter, an inflow means connected between said water holding means and said pulse chamber of regulating the inflow of said stored water from the water holding means into the pulse chamber of the separation cell, wherein when said inflow means is in an open position, said water holding means is in fluid communication with said pulse chamber, thereby allowing for said stored water from the water holding means to enter into the pulse chamber to produce water pulsion in the separation cell whenever the gravitational pressure head of the stored water from the water holding means is sufficient to overcome the resistance of the particulate solids supported on the screen support, with the intensity of the water pulsion fluctuating and responsive to changing conditions in the bed of particulate solids, responding in due course to a heavier bed of particulate solids with more intense water pulsions, and responding in due course to a lighter bed of particulate solids with less intense water pulsions, an outflow means connected laterally of or below said pulse chamber of said separation cell for regulating the outflow of water from the separation cell, wherein, said outflow means is regulated alternately to said inflow means to produce water pulsations in the separation cell, and, means for removing the separated solids produced by the water pulsations from the separation cell; and, removing the separated solids produced by the apparatus.

16. A process for separating particulate solids according to their differences in specific gravities through the use of water generated pulsation cycle, comprising the steps of:

feeding the particulate solids to be separated into an apparatus containing at least one separation cell having a pulse chamber that receives water that generates a water pulsation, a water chamber for transferring the generated water pulsation, a perforated screen support for supporting particulate solids, and a separation chamber for separating the particulate solids according to differences in their specific gravities, wherein said pulse chamber, said water chamber, and said separation chamber are in fluid communication with one another through the perforations of said perforated screen support; means for feeding the particulate solids to be separated onto said perforated screen support; at least one water holding means extending laterally of and above said pulse chamber, wherein said water holding means is exposed to the surrounding atmosphere and stores unused water accumulated from previous pulsation cycles and water supplied at a preset rate from a water supply means to produce a water column possessing a gravitational pressure head that is fluctuating and responsive to changing conditions in the bed of particulate solids, with the gravitational pressure head increasing as the bed of particulate solids becomes heavier, and with the gravitational pressure head decreasing as the bed of particulate solids becomes lighter; at least one used water holding means extending laterally of and below said pulse chamber, wherein said used water holding means channels used water from said pulse chamber; and inflow/outflow means connected between said water holding means, said pulse chamber, and said used water holding means, wherein said inflow/outflow means permits the inflow of said stored water from the water holding means into the pulse chamber of the separation cell to produce a water pulsion in the separation cell whenever the gravitational pressure head of the stored water from the water holding means is sufficient to overcome the resistance of the particulate solids supported on the screen support, with the intensity of the water pulsion fluctuating and responsive to changing conditions in the bed of particulate solids, responding in due course to a heavier bed of particulate solids with more intense water pulsions, and responding in due course to a lighter bed of particulate solids with less intense water pulsions, and wherein said inflow/outflow means alternately regulates the outflow of water from the pulse chamber of the separation cell into the used water holding means to complete the water pulsation cycle in the separation cell; and, means for removing the separated particles produced by the water pulsation from the separation cell; and, removing the separated solids produced by the apparatus.

17. The process of claim 16, wherein said inflow/outflow mean of said apparatus comprises:

a rotary valve having a housing cell, and an internal chamber in which a rotor is mounted for rotation on a drive shaft, wherein said housing is provided with an inlet port which is in fluid communication with the water holding means, an inflow/outflow port which is in fluid communication with the used water holding means, and wherein said rotor comprises a first wall means, a second wall means, a third wall means, and a fourth wall means mounted at equal 90° intervals on said drive shaft to form four separate sectors wherein an arc-shaped cover is connected between the first and the second wall means and between the third and the fourth wall means to form alternative blind sectors which prevent fluid flow and wherein the remaining sectors formed by the second and the third wall means and the fourth and the first wall means are open for fluid communication.

18. The process of claim 17, wherein said rotary valve further comprises adjustable covers attached to the housing of said rotary valve in a manner suitable for regulating the flow of water through said ports.

19. An apparatus for separating particulate solids comprising:

at least one separation cell having a pulse chamber in which water pulsations are generated, a water chamber for transferring the generated water pulsations, a perforated screen support for supporting particulate solids, and a separation chamber for separating the particulate solids, wherein said pulse chamber, said water chamber, and said separation chamber are in fluid communication with one another through the perforations of said perforated screen support;

means for feeding the particulate solids to be separated onto said perforated screen support;

at least one water holding means extending laterally of and above said pulse chamber, wherein said water holding means is exposed to the surrounding atmosphere and stores water thereby producing a water column possessing a gravitational pressure head that is fluctuating and responsive to changing conditions in the bed of particulate solids, with the gravitational pressure head increasing as the bed of particulate solids becomes heavier, with the gravitational pressure head deceasing as the bed of particulate solids becomes lighter;

an inflow means connected between said water holding means and the separation cell for regulating the inflow of said stored water possessing said gravitational pressure head into the pulse chamber of said separation cell and an outflow means connected laterally of and below said pulse chamber of said separation cell for regulating the outflow of water from the separation cell, wherein said inflow means and said outflow means are operated alternately to produce water pulsations in the separation cell; and, means for removing the separated solids produces by the water pulsations from the separation cell.

20. An apparatus for separating particulate solids according to differences in their specific gravities through the use of liquid generated pulsation cycles, comprising:

at least one separation cell having a pulse chamber that receives liquid that generates a liquid pulsation, a liquid chamber for transferring the generated liquid pulsation, a perforated screen support for supporting particulate solids, and a separation chamber for separating the particulate solids according to differences in their specific gravities, wherein said pulse chamber, said liquid chamber, and said separation chamber are in fluid communication with one another through the perforations of said perforated screen support;

means for feeding the particulate solids to be separated onto said perforated screen support;

at least one water holding means extending laterally of and above said pulse chamber, wherein said liquid holding means is exposed to the surrounding atmosphere and stores unused liquid accumulated from previous pulsation cycles and liquid supplied at a preset rate from a liquid supply means to produce a liquid column possessing a gravitational pressure head that is fluctuating and responsive to changing conditions in the bed of particulate solids, with the gravitational pressure head increasing as the bed of particulate solids becomes heavier, and with the gravitational pressure head deceasing as the bed of particulate solids becomes lighter;

an inflow means connected between said liquid holding means and said pulse chamber for permitting the inflow of said stored liquid from the liquid holding means into the pulse chamber of the separation cell, wherein said inflow means is in an open position, said liquid holding means is in fluid communication with said pulse chamber, thereby allowing for the stored liquid from the liquid holding means to enter into the pulse chamber to produce a liquid pulsion in the separation cell with the intensity of the liquid pulsion fluctuating and responsive to changing conditions in the bed of particulate solids, responding in due course to a heavier bed of particulate solids with more intense liquid pulsions, and responding in due course to a lighter bed of particulate solids with less intense liquid pulsions, whenever the gravitational pressure head of the stored liquid from the liquid holding means is sufficient to overcome the resistance of the particulate solids supported on the screen support;

an outflow means connected laterally of or below said pulse chamber of said separation cell for permitting the outflow of liquid from the separation cell, wherein, said outflow means is regulated alternately to said inflow means to produce liquid pulsations in the separation cell; and, means for removing the separation solids produced by the liquid pulsations from the separation cell.

21. The apparatus of claim 20, wherein the size of the perforations in the perforated screen support varies according to the dimensions of the particulate solids to be separated.

22. The apparatus of claim 20, wherein the perforated screen support comprises one or more sub-screen supports.

23. The apparatus of claim 20, wherein the means for removing the separated solids produced by the liquid pulsations from the separation cell are discharge gates.

24. The apparatus of claim 23, further comprising a float for regulating the discharge gates.

25. The apparatus of claim 20, wherein said liquid comprises water.

26. An apparatus for separating particulate solids according to differences in their specific gravities through the use of liquid generated pulsation cycles, comprising:

at least one separation cell having a pulse chamber that receives liquid that generates a liquid pulsation, a liquid chamber for transferring the generated liquid pulsation, a perforated screen support for supporting particulate solids, and a separation chamber for separating the particulate solids according to differences in their specific gravities, wherein said pulse chamber, said liquid chamber, and said separation chamber are in fluid communication with one another through the perforations of said perforated screen support;

a means for feeding the particulate solids to be separated onto said perforated screen support;

at least one liquid holding means extending laterally of and above said pulse chamber, wherein said liquid holding means is exposed to the surrounding atmosphere and stores unused liquid accumulated from previous pulsation cycles and liquid supplied at a preset rate from a liquid supply means to produce a liquid column possessing a gravitational pressure head that is fluctuating and responsive to changing conditions in the bed of particulate solids, with the gravitational pressure head increasing as the bed of particulate solids becomes heavier, and with the gravitational pressure head deceasing as the bed of particulate solids becomes lighter;

at least one used liquid holding means extending laterally of and below said pulse chamber, wherein said used liquid holding means channels used liquid from said pulse chamber;

an inflow/outflow means connected between said liquid holding means and said pulse chamber and said used liquid holding means, wherein said inflow/outflow permits the inflow of said stored liquid from the liquid holding means into the pulse chamber of the separation cell to produce a liquid pulsion in the separation cell whenever the gravitational pressure head of the stored liquid from the liquid holding means is sufficient to overcome the resistance of the particulate solids supported on the screen support, with the intensity of the liquid pulsion fluctuating and responsive to changing conditions in the bed of particulate solids, responding in due course to a heavier bed of particulate solids with more intense liquid pulsions, and responding in due course to a lighter bed of particulate solids with less intense liquid pulsions, and wherein said inflow/outflow means alternately permits the outflow of liquid from the pulse chamber of the separation cell into the used liquid holding means to complete the liquid pulsation cycle in the separation cell; and, means for removing the separation solids produced by the liquid pulsations from the separation cell.

27. The apparatus of claim 26, wherein the size of the perforations in the perforated screen support varies according to the dimensions of the particulate solids to be separated.

28. The apparatus of claim 26, wherein the perforated screen support comprises one or more sub-screen supports.

29. The apparatus of claim 26, wherein the means for removing the separated solids produced by the liquid pulsations from the separation cell are discharge gates.

30. The apparatus of claim 29, further comprising a float for regulating the discharge gates.

31. The apparatus of claim 26, wherein said liquid comprises water.

32. A process for separating particulate solids according to differences in their specific gravities through the use of liquid generated pulsation cycles, comprising the steps of:

feeding the particulate solids to be separated into an apparatus containing at least one separation cell having a pulse chamber that receives liquid that generates a liquid pulsation, a liquid chamber for transferring the generated liquid pulsation, a perforated screen support for supporting particulate solids, and a separation chamber for separating the particulate solids according to differences in their specific gravities, wherein said pulse chamber, said liquid chamber, and said separation chamber are in fluid communication with one another through the perforations of said perforated screen support; means for feeding the particulate solids to be separated onto said perforated screen support; at least one liquid holding means extending laterally of and above said pulse chamber, wherein said liquid holding means is exposed to the surrounding atmosphere and stores unused liquid accumulated from previous pulsation cycles and liquid supplied at a preset rate from a liquid supply means to produce a liquid column possessing a gravitational pressure head that is fluctuating and responsive to changing conditions in the bed of particulate solids, with the gravitational pressure head increasing as the bed of particulate solids becomes heavier, and with the gravitational pressure head decreasing as the bed of particulate solids becomes lighter; an inflow means connected between said liquid holding means and said pulse chamber of regulating the inflow of said stored liquid from the liquid holding means into the pulse chamber of the separation cell, wherein when said inflow means is in an open position, said liquid holding means is in fluid communication with said pulse chamber, thereby allowing for said stored liquid from the liquid holding means to enter into the pulse chamber to produce liquid pulsion in the separation cell whenever the gravitational pressure head of the stored liquid from the liquid holding means is sufficient to overcome the resistance of the particulate solids supported on the screen support, with the intensity of the liquid pulsion fluctuating and responsive to changing conditions in the bed of particulate solids, responding in due course to a heavier bed of particulate solids with more intense liquid pulsions, and responding in due course to a lighter bed of particulate solids with less intense liquid pulsions; an outflow means connected laterally of or below said pulse chamber of said separation cell for regulating the outflow of liquid from the separation cell, wherein, said outflow means is regulated alternately to said inflow means to produce liquid pulsations in the separation cell, and, means for removing the separated solids produced by the liquid pulsations from the separation cell; and, removing the separated solids produced by the apparatus.

33. The process of claim 32, wherein said liquid comprises water.

34. An apparatus for separating particulate solids comprising:

at least one separation cell having a pulse chamber in which liquid pulsations are generated, a liquid chamber for transferring the generated liquid pulsations, a perforated screen support for supporting particulate solids, and a separation chamber for separating the particulate solids, wherein said pulse chamber, said liquid chamber, and said separation chamber are in fluid communication with one another through the perforations of said perforated screen support;

means for feeding the particulate solids to be separated onto said perforated screen support;

at least one liquid holding means extending laterally of and above said pulse chamber, wherein said liquid holding means is exposed to the surrounding atmosphere and stores liquid thereby producing a liquid column possessing a gravitational pressure head that is fluctuating and responsive to changing conditions in the bed of particulate solids, with the gravitational pressure head increasing as the bed of particulate solids becomes heavier, and with the gravitational pressure head decreasing as the bed of particulate solids becomes lighter;

an inflow means connected between said liquid holding means and the separation cell for regulating the inflow of said stored liquid possessing said gravitational pressure head into the pulse chamber of said separation cell and an outflow means connected laterally of and below said pulse chamber of said separation cell for regulating the outflow of liquid from the separation cell, wherein said inflow means and said outflow means are operated alternately to produce liquid pulsations in the separation cell; and, means for removing the separation solids produced by the liquid pulsations from the separation cell.

35. The process of claim 34, wherein said liquid comprises water.

* * * * *